US006319660B1

(12) United States Patent
Allway et al.

(10) Patent No.: US 6,319,660 B1
(45) Date of Patent: Nov. 20, 2001

(54) COLOR PHOTOGRAPHIC ELEMENT CONTAINING SPEED IMPROVING COMPOUND

(75) Inventors: Philip A. Allway, Rickmansworth; Bernard A. Clark, Maidenhead; John D. Goddard, Pinner, all of (GB); Louis E. Friedrich; James A. Friday, both of Rochester, NY (US); Stephen P. Singer, Spencerport, NY (US); Marcello Vitale, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/358,057

(22) Filed: Jul. 21, 1999

Related U.S. Application Data

(63) Continuation-in-part of application No. 09/221,359, filed on Dec. 28, 1998.

(51) Int. Cl.[7] ..... G03C 1/08

(52) U.S. Cl. ..... 430/600; 430/503; 430/505; 430/506; 430/611; 430/613; 430/615

(58) Field of Search ..... 430/503, 505, 430/506, 600, 611, 613, 615

(56) References Cited

U.S. PATENT DOCUMENTS

| | | | | |
|---|---|---|---|---|
| 3,933,500 | | 1/1976 | Shiba et al. . | |
| 4,528,264 | | 7/1985 | Ishiguro et al. . | |
| 4,604,339 | * | 8/1986 | Sugimoto et al. | 430/244 |
| 4,643,966 | | 2/1987 | Maskasky . | |
| 4,770,991 | | 9/1988 | Kojima et al. . | |
| 4,837,141 | | 6/1989 | Kohno et al. . | |
| 5,006,467 | | 4/1991 | Kusano et al. . | |
| 5,032,499 | | 7/1991 | Kohno et al. . | |
| 5,100,761 | | 3/1992 | Yagihara et al. . | |
| 5,116,723 | * | 5/1992 | Kajiwara et al. | 430/611 |
| 5,187,054 | * | 2/1993 | Dewanckele et al. | 430/523 |
| 5,230,995 | * | 7/1993 | Asami | 430/567 |
| 5,328,799 | | 7/1994 | Freedman et al. . | |
| 5,411,929 | | 5/1995 | Ford et al. . | |
| 5,508,154 | | 4/1996 | Mizukawa et al. . | |
| 5,702,877 | | 12/1997 | Odenwalkder et al. . | |
| 5,766,835 | * | 6/1998 | Matsunaga | 430/523 |
| 5,908,736 | * | 6/1999 | Yamazaki | 430/531 |

FOREIGN PATENT DOCUMENTS

| | | | |
|---|---|---|---|
| 2 053 714 | | 5/1971 | (DE) . |
| 2 363 308 | | 6/1974 | (DE) . |
| 2 419 798 | | 11/1974 | (DE) . |
| 26 09 993 | | 9/1976 | (DE) . |
| 39 24 571 A1 | | 2/1990 | (DE) . |
| 0 157 322 B1 | | 10/1985 | (EP) . |
| 0 197 895 | | 10/1986 | (EP) . |
| 0 256 781A2 | | 2/1988 | (EP) . |
| 0 335 319 B1 | | 10/1989 | (EP) . |
| 0 574 331 B1 | | 12/1993 | (EP) . |
| 0 652 470 A1 | | 5/1995 | (EP) . |
| 652470 | * | 10/1995 | (EP) . |
| 0 741 319 A1 | | 11/1996 | (EP) . |
| 0 952 485A1 | | 10/1999 | (EP) . |
| 52-154631 | | 12/1977 | (JP) . |
| 60-173546 | | 9/1985 | (JP) . |
| 61-014630 | | 1/1986 | (JP) . |
| 61-025346 | | 2/1986 | (JP) . |
| 62-055644 | | 3/1987 | (JP) . |
| 62-188350 | | 8/1987 | (JP) . |
| 63-24255 | | 2/1988 | (JP) . |
| 63-100446 | | 5/1988 | (JP) . |
| 64-019343 | | 1/1989 | (JP) . |
| 01-097946 | | 4/1989 | (JP) . |
| 02-062532 | | 3/1990 | (JP) . |
| 03-013934 | | 1/1991 | (JP) . |
| 03-138639 | | 6/1991 | (JP) . |
| 03-241339 | | 10/1991 | (JP) . |
| 04-67140 | | 3/1992 | (JP) . |
| 04-107446 | | 4/1992 | (JP) . |
| 04-186344 | | 7/1992 | (JP) . |
| 04-336538 | | 11/1992 | (JP) . |
| 05-127279 | | 5/1993 | (JP) . |
| 05-127290 | | 5/1993 | (JP) . |
| 05-232618 | | 9/1993 | (JP) . |

(List continued on next page.)

OTHER PUBLICATIONS

Research Disclosure 38597, Section x (D), Sep. 1996.*
Research Disclosure 37038 Sections I (A&B), III, XV(A), VII, XXIII(B), Feb. 1995.*
Defensive Publication US 877,011 published Aug. 18, 1970—Use of Silver Pi–Complex Stabilizers, Kenneth R. Dunham.
2091846 Abstract.
2091858 Abstract.
05 333496A Abstract.
Tadaaki Tani: "Photographic Sensitivity" 1995, Oxford Un Press, New York, Oxford XP002137274 55196 pp. 191–199* Included in European Search Report (enclosed).
Defensive Publication US 877,011 published Aug. 18, 1970—Use of Silver Pi–Comples Stabilizers, Kenneth R. Dunham.
The Theory of the Photographic Process, T.H. James, Ed., 4th Edition, Macmillan Publishing Co, Ny, Chapter 13, Section J.
Photographic Sensitivity, Theory and Mechanisms, T. Tani, Oxford University Press, NY, 1995, Section 6.5.

*Primary Examiner*—Janet Baxter
*Assistant Examiner*—Amanda C Walke
(74) *Attorney, Agent, or Firm*—Arthur E. Kluegel

(57) ABSTRACT

Disclosed is a color photographic element comprising at least one of (1) a light sensitive silver halide emulsion layer and (2) a non-silver containing light insensitive layer, said at least one layer containing a compound with a minimum of three heteroatoms that does not react with oxidized developer and that has a ClogP sufficient to increase the photographic speed of said element compared to the same element without the compound. The invention provides improved light sensitivity.

133 Claims, No Drawings

FOREIGN PATENT DOCUMENTS

| | | |
|---|---|---|
| 05 333496A | 12/1993 | (JP) . |
| 05-033496 | 12/1993 | (JP) . |
| 06-059363 | 3/1994 | (JP) . |
| 06-230511 | 8/1994 | (JP) . |
| 06-347954 | 12/1994 | (JP) . |
| 07-168303 | 7/1995 | (JP) . |
| 07-261308 | 10/1995 | (JP) . |
| 07-270955 | 10/1995 | (JP) . |
| 07-270957 | 10/1995 | (JP) . |
| 07-281334 | 10/1995 | (JP) . |
| 07-281345 | 10/1995 | (JP) . |
| 08-137043 | 5/1996 | (JP) . |
| 08-262601 | 10/1996 | (JP) . |
| 09-106024 | 4/1997 | (JP) . |
| 09-265150 | 10/1997 | (JP) . |
| 10-50047 | 2/1998 | (JP) . |
| 10-104784 | 4/1998 | (JP) . |
| 10-148917 | 6/1998 | (JP) . |
| 10-221805 | 8/1998 | (JP) . |
| 10-228077 | 8/1998 | (JP) . |
| 2091858 | 1/1980 | (RU) . |
| 2091846 | 5/1983 | (RU) . |

* cited by examiner

COLOR PHOTOGRAPHIC ELEMENT CONTAINING SPEED IMPROVING COMPOUND

CROSS-REFERENCE TO RELATED APPLICATION

This application is a Continuation-in-Part of U.S. Ser. No. 09/221,359, filed Dec. 28, 1998, the contents of which are incorporated herein by reference.

FIELD OF THE INVENTION

This invention relates to a color photographic element containing a speed improving compound with at least 3 heteroatoms in a layer containing a light-sensitive silver halide emulsion layer or in a non-silver containing light insensitive layer.

BACKGROUND OF THE INVENTION

It is a long-standing objective of color photographic origination materials to maximize the overall response to light while maintaining the lowest possible granularity. Increased photographic sensitivity to light (commonly referred to as photographic speed) allows for improved images captured under low light conditions or improved details in the shadowed regions of the image. In general, the overall light sensitivity provided by the light sensitive silver halide emulsions in such systems is determined by the size of the emulsion grains. Larger emulsion grains capture more light. Upon development, the captured light is ultimately converted into dye deposits which constitute the reproduced image. However, the granularity exhibited by these dye deposits is directly proportional to the grain size of the silver halide emulsion. Thus, larger silver halide emulsion grains have higher sensitivity to light but also lead to higher granularity in the reproduced image. Therefore, it is a fundamental problem in photography to improve the light sensitivity of a silver halide element without a corresponding decrease in another property such as granularity. In this description, it will be understood that the demonstrated increase in sensitivity is accomplished without a significant sacrifice in granularity. Stated from another perspective, it has been a long-standing problem to provide materials which maximize the response to light of a silver halide emulsion for any given grain size.

For example, it is well known that highly reactive couplers or couplers that form dyes with high extinction coefficients can maximize the response of silver halide emulsions. However, the increased amplification caused by these types of dye forming materials also directly leads to higher granularity.

It is highly desirable to provide non-imaging materials that lead to increased photographic speed without having to increase the size of the light-sensitive silver halide grains.

Many different classes of heterocyclic materials are known to affect silver development in some manner and have been called, for example, antifoggants, fog restrainers, development restrainers, development inhibitors and stabilizers. Descriptions of these materials can be found in *The Fundamentals of Photographic Technology, Silver Salt Photography*, compiled by the Photographic Society of Japan (Corona, Ltd.), p 354; *Chemistry of Photography*, A. Sasai (Shashin Kogyo Shuppan Co, Ltd.), pp 168–169 and T. H. James, Ed, *The Theory of the Photographic Process*, $4^{th}$ Edition, Macmillan Publishing Co, New York, Chapter 13, Section J. Commonly, these materials all contain an NH or SH group which allows them to bond or strongly adsorb to the silver surface and whose silver salts have a $pK_{sp}$ (−log $K_{sp}$) of more than 10, where $K_{sp}$ is the solubility product in water at 25° C. It is well known to add these materials to silver halide emulsions in conventional color photographic systems to limit or decrease their development. These materials are generally at least partially water soluble or soluble in water-miscible solvents such as methanol and are added directly to silver emulsions before coating of the film or added directly to the developer solutions. It is also known to attach these types of heterocycles covalently to PUGs (photographically useful groups) so that the PUG will be held in close proximity to the silver surface, for example, see U.S. Pat. No. 5,100,761.

U.S. Pat. Nos. 5,032,499, 4,837,141 and JP 62-138850 describe the use of a wide variety of photographic restrainers (including diazoles, triazoles, tetrazoles and tetraazaindenes) in thermally developable light sensitive materials. JP 10-50047 describes a wide variety of anti-silver sludging agents (including diazoles, triazoles, tetrazoles and tetraazaindenes) in a non-light sensitive cleaning film.

Substituted purines (1,3,4,6-tetraazaindenes) and other bicyclic heterocycles are known to be useful in photographic systems as antifoggants; for example, as in Japanese Patent Applications JP 07-281345A2; JP 03-013934A2; JP 03-138639A2; JP 04-107446A2; JP 04-067140A2; JP 05-127290A2; JP61-256346A2 and EP-741319A1 and as described in E. J. Birr, *Stabilization of Photographic Silver Halide Emulsions*, Focal Press, Ltd, 1974, pp 82–93. Purines are also described in Def. Publ. U.S. Pat. No. 877,011 to be useful as silver pi-complex stabilizers in photographic systems. Purines used as inhibitor fragments as part of a DIR ("Development Inhibitor Releasing" coupler) are disclosed in U.S. Pat. No. 3,933,500. Purines as a blocking group for the release of photographically useful groups during processing are described in JP 04-186344A2 and EP-335319A2. Derivatives of 6-aminopurines as addenda in high contrast black and white media have been described in JP 10-104784A2; JP 10-228077A2; JP 09-106024A2 and JP 04-336538A2. U.S. Pat. No. 5,411,929 and U.S. Pat. No. 5,328,799 describe the use of purines (including 6-dodecylaminopurine (inventive compound AA)) in thermally processed image recording materials. JP 02-62532 describes the use of purines in a layer adjacent to an imaging layer in a high contrast black and white graphic art film system.

Water soluble 1,2,3a,7-tetraazaindenes are known stabilizers and antifoggants; for example, see JP 07-281334A2; JP 06-347954A2; JP 06-230511A2; JP 05-127279A2; JP 05-232618A2; JP 03-241339A2; JP 62-055644A2; JP 60-173546A2; DE-2609993; DE-2419798 and E. J. Birr, loc cit. Water soluble 1,2,3a,7-tetraazaindenes are known to be useful addenda for silver halide precipitation as described in JP 61-014630A2; Czech Patent CS-255602 and U.S. Pat. No. 4,643,966. Water soluble thiol substituted 1,2,3a,7-tetraazaindenes are described as silver sludge preventers in JP 10-148917A2, EP 652470A1 and JP 08-137043A2 describes the use of tetraazaindene substituted hydrazines for use as development accelerators. JP 01-019343A2 describes the use of polymeric 1,2,3a,7 and 1,3,3a,7-mercaptotetraazaindenes.

Water soluble 1,3,3a,7-tetraazaindenes are well-known stabilizers and antifoggants; for example, see E. J. Birr, loc cit, and T. Tani, *Photographic Sensitivity, Theory and Mechanisms*, Oxford University Press, New York, 1995, Section 6.5. In particular, 4-hydroxy-6-methyl-1,3,3a,7-tetraazaindene (ClogP (as hereinafter defined)=−0.27) is widely used in photographic film. It is also known (for example, see T. Tani, loc cit, pp 191–194 and the references within) that this particular compound can cause increased photographic speed under some circumstances. Less water soluble 1,3,3a,7-tetraazaindenes with ClogP less than 6.0 have been described in JP 08-262601A2; EP 574331A2; JP 01-097946A2 and EP 197895A2. JP 06-059363A2 describes the use of polymeric 6-hydroxy-1,3,3a,7-tetraazaindenes as addenda for silver halide precipitations. Czech patent CS 255602B1 and Russian patents RU 2091846C1 and RU 2091858C1 describe the use of 2-heptyl-4-hydroxy-5-bromo-6-methyl-1,3,3a-tetraazaindene (ClogP=3.82) as an addendum for silver halide precipitations. JP 07-270955A2 and JP 07-270957A2 describe the combination of hydrazines with less water soluble tetraazaindenes with ClogP of less than 6.0. JP 10-221805, JP 09-265150A2; DE 3924571A1; EP 335319A2 and DE 2363308 all describe 1,3,3a,7-tetraazaindenes as suitable blocking groups for the release of photographically useful groups during processing. JP 52-154631 describes the use of certain 1,3,3a,7-tetraazaindenes as an inhibitor fragment as part of a DIR. DE 2053714 discloses the use of amides in combination with water soluble tetraazaindenes. JP 09-265150A2 discloses the use of 4-tribromomethylsulfonyl-6-pentadecyl-1,3,3a,7-tetraazaindene (ClogP=8.97) for use in thermally developable systems.

JP 05-333496A2 describes the combination of pyrroloazole cyan couplers with a wide variety of 1,2,3a,7- and 1,3,3a,7-tetraazaindene compounds in a color photographic print system using silver chloride emulsions for the purpose of improving cyan color in rapid processes. Out of 28 examples of tetraazaindenes shown, Xa-1 (ClogP=7.96), Xa-5 (ClogP=8.19), Xa-10 (ClogP=8.46), Xa-22 (ClogP=7.92), Xb-1 (ClogP=8.20) and Xb-4 (ClogP=8.74) have ClogP greater than 6.2.

JP 07-168303A2 describes a wide variety of 1,3,3a,7-tetraazaindenes in combination with hydrazines in high contrast graphic art materials using silver chloride emulsions for improved storage stability. Out of 48 examples of tetraazaindenes shown, only 2-(2,5-di-t-pentylphenoxy)-4-hydroxy-5-bromo-6-methyl-1,3,3a,7-tetraazaindene (III-7; ClogP=7.73) has a ClogP greater than 6.2. JP 7-261308 describes a number of ballasted triazoles in a similar high contrast graphic art material.

U.S. Pat. No. 5,187,054 describes the use of ballasted heterocycles that contain a NH bond but do not contain any thiol substituents in a top layer to prevent silver sludging. Of the compounds shown, the highest ClogP of a benzimidazole (I-8) is 7.15 and a triazole (I-7) is 8.60.

JP 63-24255 describes a wide variety of diazoles, triazoles, mercaptotetrazoles and benzotriazoles, all with ClogP of less than 5.0, in a color photographic film. U.S. Pat. No. 4,770,991 also describes a wide variety of mercapto-1,2,4-triazoles (maximum ClogP=6.43), mercaptothiadiazoles (maximum ClogP=5.14) and mercaptotetrazoles (maximum ClogP=7.02) in a high contrast black and white film. JP 63-100446 describes the use of mercaptooxadiazoles (maximum ClogP=5.18) and mercaptothiadiazoles (maximum ClogP=4.12) in a black and white film. U.S. Pat. No. 5,006,467 discloses the use of 1,2,3-triazoles (maximum ClogP of examples shown=5.10) and EP 0 157 322 B1 discloses 1,2,4-triazoles (maximum ClogP=5.99) as antifoggants.

U.S. Pat. No. 4,528,264 describes the use of polymeric benzotriazoles prepared from benzotriazole monomers with ClogP of less than 5.0.

U.S. Pat. No. 5,508,154 describes the use of 5/5 bicyclic heterocycles in which one ring is a 1,2,3-triazole, and both rings together contain a minimum of 4 nitrogen atoms as antifoggants in systems that contain inhibitor releasing couplers. Of the examples shown, these heterocycles have an average ClogP of 1.53 with a maximum of 5.67 (example A-7). The patentee also notes that 6/5 membered bicyclic heterocycles with 4 nitrogen atoms do not produce the desired result.

U.S. Pat. No. 5,702,877 describes the use of ballasted benzimidazoles to improve granularity particularly with certain pyrazolone image couplers.

A problem to be solved is to provide color photographic elements that exhibit improved photographic speed and methods for processing such elements.

SUMMARY OF THE INVENTION

The invention provides a color photographic element comprising at least one of (1) a light sensitive silver halide emulsion layer and (2) a non-silver containing light insensitive layer, said at least one layer containing a compound with a minimum of three heteroatoms that does not react with oxidized developer and that has a ClogP sufficient to increase the photographic speed of said element compared to the same clement without the compound.

In various aspects of the invention, the imaging layer that contains the compound comprises an iodobromide emulsion, is sensitized to green light, comprises a particular grain size, includes a particular type of coupler, is an origination material, and is processed with a color developer such as a paraphenylene diamine developer. In other aspects of the invention, the compound is a particular kind of heterocycle with a minimum of three heteroatoms including a tetraazaindene, a benzotriazole, a triazole, a tetrazole, a thiadiazole or a oxadiazole.

The invention provides color photographic elements that exhibit improved photographic speed and methods for processing such elements.

DETAILED DESCRIPTION OF THE INVENTION

The invention is generally as described in the Summary of the Invention. The present invention relates to a light sensitive color photographic element with at least one red sensitive silver halide emulsion layer with at least one non-diffusing cyan coupler, at least one green sensitive silver halide emulsion layer with at least one non-diffusing magenta coupler and at least one blue sensitive silver halide emulsion layer with at least one non-diffusing yellow coupler, characterized in that at least one light sensitive silver halide emulsion layer or a non-silver containing light insensitive layer contains a compound with a minimum of three heteroatoms that does not react with oxidized developer and that has a ClogP for said compound sufficient to increase the speed of at least one of the imaging (light sensitized) layers in said element compared to the same layer without the compound. It is desired that the compound of the invention should achieve an improvement in terms of photographic speed of at least 0.05, and desirably at least 0.10 and even 0.25 stops or more without causing a significant increase in granularity.

The term "heteroatom" as used herein encompasses any atom other than carbon or hydrogen and includes, for example, nitrogen, sulfur, phosphorous and oxygen. If the compound is heterocylic, then the term "heteroatom" refers only to those atoms which form an integral part of the ring system and not those that are located externally to the ring system or separated from it by at least one single, unconjugated bond or are part of an additional substituent of the ring system.

The compounds of the invention, or "speed compounds", are similar to compounds known to cause inhibition of silver development, but because of their increased hydrophobicity (as measured by a higher ClogP) they do not cause inhibition of silver development per se. Among the classes of compounds that contain a minimum of three heteroatoms and are known to cause inhibition of silver development (see references in the background of the invention) and can be included in the invention when appropriately substituted to increase hydrophobicity are: triazoles, oxadiazoles, thiadiazoles, oxathiazoles, thiatriazoles, benzotriazoles, tetrazoles, mercaptotetrazoles, selenotetrazoles, mercaptothiadiazoles, mercaptotriazoles, mercaptooxadiazoles, telleurotetrazoles, benzisodiazoles, thioureas, purines and other polyazaindenes. Formulations useful for the purpose of the invention, namely an increase in photographic speed, have the desired overall hydrophobicity (as measured by ClogP) and do not cause a significant inhibition of silver development. The minimum ClogP for speed improvement may vary somewhat for each class of compound useful in this invention.

Even though the speed compounds of the invention are not inhibitors of silver development, they are generally in a class whose lower ClogP members are inhibitors of silver development. Any of the following tests could be used on lower ClogP compounds to identify if any particular class of compound is of a type within the present invention, even though the compound itself, having a larger ClogP, is not an inhibitor of silver development.

Two different tests of potential inhibiting activity are described in *Photogr Sci and Eng,* 5,283 (1961) and in *Photogr. Sci and Eng,* 18,383 (1974). Another test is based on binding to silver ions, which is crucial for inhibition of silver development. Silver chloride is a useful material for emulsion-based photography, the strength of the binding of chloride to silver ions defines a lower limit of binding strength for active materials. Accordingly, the following test defines those classes of molecules that bind to silver ions that are covered under the invention described herein provided they are modified to have the desired minimum ClogP. First, to test a class, an example that is soluble at pH 10 in a carbonate buffer was chosen and a 50 ml solution that is 0.00100 M in the compound, 0.0200 M in potassium bicarbonate, and 0.0267 M in potassium carbonate was prepared and the pH was adjusted to 10.0 with either 1 M nitric acid or sodium hydroxide. With magnetic stirring, and at a temperature between 20 and 25° C. and under nitrogen, there was added 1 ml of 0.000500 M silver nitrate. Using any valid electrochemical method for measuring silver ion concentrations, the free silver ion molarity 15 min after addition was determined. The entire process was repeated at the same temperature and under other conditions with 0.00100 M sodium chloride in place of the test compound. Any substance that lowers the silver ion molarity more than does 0.00100 chloride is an active class in the invention described herein.

Suitably, the compounds of the invention are heterocycles. One preferred class of heterocycles of the invention is polycyclic nitrogen heterocycles; such as those that contain at least two ring systems composed only of carbon and at least three nitrogen atoms. Specific examples of preferred polycyclic nitrogen heterocycles with at least three nitrogen atoms as part of the ring system are benzotriazoles and tetraazaindenes (including purines). Another preferred class of heterocycles of the invention are monocyclic heterocycles comprising carbon and at least two nitrogen atoms with at most only one ring sulfur or ring oxygen atom. Specific classes of these preferred heterocycles are triazoles, oxadiazoles, thiadiazoles and tetrazoles.

The substituents located directly on the heterocycles of the invention can be hydrogen or any group chosen such that together the entire compound meets the overall ClogP requirement. These substituents may be alkyl, aryl, alkoxy or aryloxy, alkylthio or arylthio, sulfoxyl, sulfonyl, sulfamoyl

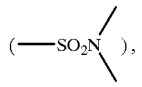

halo such as fluoro, chloro, bromo or iodo, cyano, thiol, hydroxy, nitro, —O—CO-, —O—$SO_2$—, a heterocyclic group such as furanyl or morpholino, a carbonyl group such as keto, carboxylic acid (—$CO_2H$), carboxylate ester (—$CO_2$—) or carbamoyl

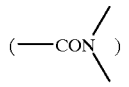

or an amino group such as a primary, secondary or tertiary substituted nitrogen, carbonamido (>NCO—) or sulfonamido (>$NSO_2$—). A substituent may also connect two or more independent nitrogen heterocycle nuclei together so long as the entire molecule still meets the ClogP limitations. In addition, the substituent may further contain a group that can be incorporated into a polymeric backbone so long as the monomeric species meets the ClogP limitations. It should be noted wherever it is possible to write alternative tautomeric structures of the heterocyclic nucleus, these are considered to be chemically equivalent and are part of the invention.

More preferred forms of the polycyclic nitrogen heterocycles of the invention contain a 6/6 or 6/5 two-ring bicyclic nucleus in which the two rings contain at least 4 nitrogen atoms over both ring systems so long as no three nitrogen atoms are consecutive, that is, directly connected to each other, unless one of the three consecutive nitrogens occupies a bridgehead position or all three nitrogens are located in the same six membered ring. Any particular nitrogen atom may be part of only one ring or be located in a bridgehead position. A bridgehead position is where an atom forms part of more than one ring. In addition, it is possible that other ring systems may be annulated to these heterocyclic ring systems or even be located between these rings so long as two rings (at least one of which must be a six membered ring) contain, between them, at least 4 nitrogen atoms and do not contain 3 nitrogen atoms directly connected to each other unless one of the three nitrogens occupies a bridgehead position or all three nitrogens are located in the same six membered ring. The additional rings may or may not contain additional nitrogen atoms or other heteroatoms such as sulfur or oxygen. None of the rings that comprise the heterocyclic nucleus are isolated or joined only by a single bond. It is preferred that the heterocyclic nucleus be aromatic or pseudo-aromatic. Another preferred form of polycyclic nitrogen heterocycle is benzotriazole, which contains only 3 nitrogen atoms, that are connected to each other and none of which occupies a bridgehead position.

A particularly preferred form of the heterocycle of the invention is a 6/5 bicyclic aromatic nitrogen heterocycle that contains at least 4 nitrogen atoms as part of the ring system and does not contain 3 nitrogen atoms directly connected to each other unless one of the three nitrogen atoms occupies a bridgehead position or all three nitrogen atoms are located in the same six membered ring and is substituted so that the overall ClogP for the compound is at least 6.2. It is preferred that the ClogP should be at least 6.8 or suitably at least 7.2. It is also preferred that the ClogP be equal to or less than 13.0, conveniently less than 11.5.

Some examples of the 6/5 bicyclic heterocycle compounds of the invention are the following tetraazaindenes and pentaazaindenes (numbered according to the structure below): 1,3,4,6 and 1,3,5,7 (both also known as purines); 1,3,5,6; 1,2,3a,4; 1,2,3a,5; 1,2,3a,6; 1,2,3a,7; 1,3,3a,7; 1,2,4,6; 1,2,4,7; 1,2,5,6 and 1,2,5,7. These compounds may also be described as derivatives of imidazo, pyrazolo- or triazolo-pyrimidines, pyridazines or pyrazines. Some examples of pentaazaindenes are 1,2,3a,4,7; 1,2,3a,5,7 and 1,3,3a,5,7. An example of a hexaazaindene would be 1,2,3a,4,6,7.

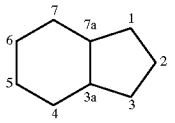

The more preferred examples are in which the 6/5 bicyclic nitrogen heterocycle are 1,3,4,6; 1,2,5,7; 1,2,4,6; 1,2,3a,7 or 1,3,3a,7-tetraazaindene derivatives.

For these types of polycyclic nitrogen heterocycles, ionizable substituents, such as hydroxy (—OH), thiol (—SH) or non-tertiary amino groups (—$NH_2$ or —NH—) are attached to a ring atom such that conjugation to a ring nitrogen can occur to provide tautomeric forms of the heterocycle. It is preferred to have none of this kind of substituent, unless there is a bridgehead nitrogen in which case it is preferred to have at most only one hydroxy or thiol group, to maintain the desired degree of silver interaction.

The most preferred examples of a purine derivative are according to Formula I:

I

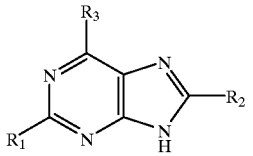

wherein $R_1$ and $R_2$ are each independently hydrogen or an alkyl, aryl, alkoxy or aryloxy, alkylthio or arylthio, sulfoxyl, sulfonyl, sulfamoyl, halo such as fluoro, chloro, bromo, and iodo, cyano, nitro, —O—CO—, —O—$SO_2$—, a heterocyclic group, a carbonyl group such as keto, carboxylic acid, carboxylate ester or carbamoyl or an amino group such as a primary, secondary or tertiary substituted nitrogen, carbonamido or sulfonamido. $R_3$ is an alkyl, aryl, alkoxy, aryloxy, alkylthio, arylthio, sulfonyl, sulfoxyl, secondary or tertiary amino group, carbonamido group or a sulfonamido group all of which may be substituted as provided hereinafter. Compounds in which $R_3$ is an alkoxy or alkylthio group are especially preferred. The overall ClogP should be at least 6.2, or more preferably, at least 6.8 or most preferably, at least 7.2 with a maximum ClogP equal to or less than 13.0.

The most preferred examples of a 1,2,5,7-tetraazaindene derivative are according to Formula IIa or a 1,2,4,6-tetraazaindene derivative are according to Formula IIb:

IIa

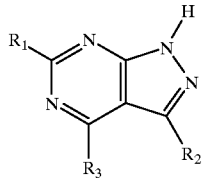

IIb

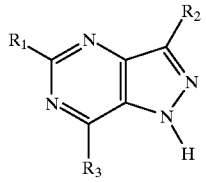

wherein $R_1$, $R_2$ and $R_3$ are each defined above. Compounds in which $R_3$ is an alkoxy or alkylthio group are especially preferred. The overall ClogP should be at least 6.2, or more preferably, at least 6.8 or most preferably, at least 7.2 with a maximum ClogP equal to or less than 13.0.

The most preferred examples of a 1,2,3a,7-tetraazaindene derivative are according to Formula III:

III

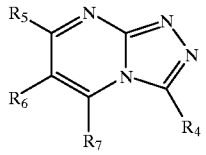

wherein $R_4$, $R_5$, $R_6$ and $R_7$ are each as defined for $R_1$ and $R_2$ but also including thiol or hydroxy groups. Especially preferred are compounds where $R_7$ is a hydroxy group, $R_5$ is an alkyl group and $R_4$ is the same as defined for $R_3$ with alkyl, aryl, alkoxy, arylthio, or alkylthio groups being particularly beneficial. The overall ClogP should be at least 6.2, or more preferably, at least 6.8 or most preferably, at least 7.2 with a maximum ClogP equal to or less than 13.0.

The most preferred examples of a 1,3,3a,7-tetraazaindene derivative are according to Formula IV:

IV

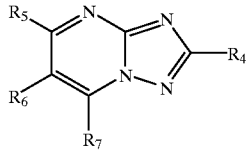

wherein $R_4$, $R_5$, $R_6$ and $R_7$ are the same as for Formula III. Especially preferred are compounds where $R_7$ is a hydroxy group, $R_5$ is an alkyl group and $R_4$ is the same as defined for $R_3$ with alkoxy or alkylthio groups being particularly beneficial. The overall ClogP should be at least 6.2, or more preferably, at least 6.8 or most preferably, at least 7.2 with a maximum ClogP equal to or less than 13.0.

Another preferred form of the heterocycle of the invention is a benzotriazole in which the overall ClogP for the compound is at least 7.8, or more preferably at least 8.2 or most preferably at least 9.0. It is also preferred that the ClogP be equal to or less than 13.0. The more preferred examples of a benzotriazole are according to Formula V wherein $R_8$, $R_9$, $R_{10}$ and $R_{11}$, are each individually defined as for $R_1$ and $R_2$ above. The most preferred examples of a benzotriazole derivative are where $R_8$, and $R_{11}$, are hydrogen and where $R_9$ is a carboxylate ester, a carbamoyl group, a carbonamido group, a sulfonamido group or an alkoxy or aryloxy group.

V

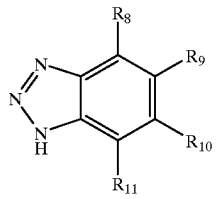

Another preferred form of the nitrogen heterocycle of the invention is a triazole in which the overall ClogP for the compound is at least 8.75, or more preferably at least 9.0 or most preferably at least 9.25 and equal to or less than 13.0. The more preferred examples of a triazole are 1,2,3-triazoles according to Formula VI and 1,2,4-triazoles according to Formula VII wherein $R_{12}$ and $R_{13}$ are each individually defined as for $R_1$ and $R_2$ above. The most preferred examples of triazoles are where $R_{12}$ is hydrogen, alkyl or aryl and $R_{13}$ is an alkylthio or arylthio, carboxylate ester or substituted alkyl group.

VI

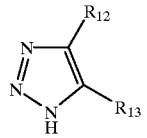

VII

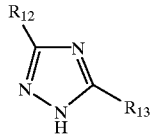

Another preferred form of the nitrogen heterocycle of the invention is a diazole in which the overall ClogP for the compound is at least 7.6, or more preferably at least 7.9 or most preferably at least 8.2 and equal to or less than 11.5. The more preferred examples of a diazole are according to Formula VIII wherein X is oxygen or sulfur and $R_{14}$ and $R_{15}$ are each individually defined as for $R_1$ and $R_2$ but also including a thiol group. The most preferred examples of an oxadiazole or a thiadiazole are where $R_{14}$ is a thiol group and $R_{15}$ is an alkyl, aryl, alkylthio or arylthio or amino group.

VIII

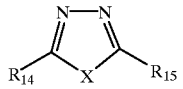

Another preferred form of the nitrogen heterocycle of the invention is a tetrazole. The more preferred examples of a tetrazole are according to Formula IX wherein $R_{16}$ is as defined for $R_1$ including a thiol (—SH) group (when $R_{16}$ is a thiol group, such compounds are known as mercaptotetrazoles) and $R_{17}$ is as defined as $R_1$. The most preferred examples of a tetrazole are when $R_{16}$ is a thiol group and $R_{17}$ is an alkyl, aryl or heterocyclic group; or when $R_{17}$ is hydrogen and $R_{16}$ is an alkyl, aryl, amino, alkoxy or aryloxy, heterocyclic or alkylthio or arylthio group. When $R_{16}$ is a thiol group, then the ClogP for the compound should be at least 7.0 or more preferably at least 7.4 or most preferably at least 7.8 and preferably the ClogP should be equal or less than 13.0. When $R_{16}$ is not a thiol group, then the ClogP for the compound should be at least 6.5 or more preferably at least 7.0 or most preferably at least 7.5 and should be less than or equal to 10.5.

IX

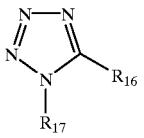

The compounds useful in the invention are not couplers and do not react with oxidized developer (Dox) to generate dyes or any other product. It is desired that the compounds of the invention do not undergo any significant amounts (less than 5–10%) of chemical or redox reaction directly with oxidized color developer. They are colorless. They are stable to other components of the processing solutions and do not contain substituents that undergo substantial amounts of chemical reaction in any of the processing solutions (except when the compound has a suitable NH, OH or SH bond replaced by a temporary blocking group that is removed in a non-imagewise fashion as detailed below). For example, the inventive materials do not contain hydrazino or hydroquinone groups that may cross-oxidize during silver development nor are they covalently linked to any other kind of photographic useful group (PUG). However, the inventive materials may contain, for example, ester substituents that are not substantially hydrolyzed (less than 5–10%) during the development process. The compounds of the invention are located in the film element as described and are not added to the processing solutions.

An important feature of the compounds of the invention is their hydrophobicity which is related to their octanol/water partition coefficient (logP). In order to maximize the photographic effect, the partitioning into water cannot be so low that the material is unable to reach the surface of the emulsion grains. It has also been found that the partitioning into water cannot be too high. Because it can be difficult to measure logP values above 3, a model can be used to compute an estimate of logP, called ClogP that defines the limits of the invention. The model used is MEDCHEM Version 3.54, which is a software program produced by the Medicinal Chemistry Project at Pomona College in California.

One way to enter a structure into the MEDCHEM program in order to calculate a ClogP is through a SMILES string. The way to enter the SMILES string for a nitrogen compound is to enter all non-hydrogen atoms as capitals and let the MEDCHEM program determine the appropriate aromaticity. An example is shown for compound A below: CCCCCCCCCCCCCCOC1=C2N=CNC2=NC=N1. This entry gives the value 6.91. When the entry is in this form, the heterocyclic N—H will be drawn in the structure by the MEDCHEM program. If the entry is not in this form, the MEDCHEM program will not display the heterocyclic N—H group and the resulting ClogP value is incorrect. Structures such as A and AJ can be drawn in multiple tautomeric forms, for example, hydrogens on different ring atoms, enol or keto tautomeric forms (or thiol or thione forms for sulfur compounds). If ClogP values can be calculated for more than one tautomeric form of a single compound and at least one of those values is within the specified range for that class, then the compound is within the scope of the invention. Some tautomers may not compute in MEDCHEM 3.54, because there is a fragment in the molecule that is missing in the MEDCHEM database. In such a case, logP of the nucleus of the molecule (with appropriate aromatic or aliphatic substituents) must be experimentally measured and the missing fragment value must be entered into the algorithm manager of MEDCHEM as instructed by the manual.

For the purposes of this invention, the ClogP refers to neutral molecules, even if they would be ionized or protonated (either fully or in part) at the processing pH or at the ambient pH of the photographic film. Thus, in practice, it is highly desirable that the substituents of the compound of the invention do not contain additional very low $pK_a$ (<7) groups such as sulfonic or carboxylic acids nor very basic groups (pKa of conjugate acid <10) such as a tertiary amino group (unless such an amino group is attached to a heterocylic ring such that it is conjugated to a nitrogen atom, in which case its basicity is greatly reduced) since they require an increase in the size and amount in the rest of the hydrophobic substituents in order to meet the overall ClogP requirements.

There is a specific range of ClogP for each class of compounds, depending on its particular nature, which should not be exceeded. For most examples, it is preferred that the ClogP not exceed 13.0 or more preferably for some types of compounds, not to exceed 11.5. When the compound has a ClogP equal to or greater than some minimum value to show the desired speed effect silver inhibition does not occur. For most examples, the ClogP should not be lower than 6.2 and it is preferred that the ClogP of the compound be at least 6.8 or greater or even 7.2 or greater.

One of the most important and novel characteristics of the compounds of this invention is the finely tuned balance between their hydrophobic and hydrophilic nature. The hydrophobic/hydrophilic nature of a compound can be estimated by calculation of its partition coefficient between octanol and water (ClogP) using the MEDCHEM program, and this has been used herein to define the range of values of ClogP for each class of compound within which they exhibit the desired effect. The terms 'ballast' or 'ballasted' as generally applied in the photographic art are often applied only loosely and without quantification to imply a restriction of movement. The activity of the inventive compounds is therefore best defined in terms of their calculated ClogP values.

For each compound of the invention, as the laydown is increased a threshold level is reached following which the speed improvement gradually increases with laydown, after which the improvement then levels off at a compound specific maximum level. It will be appreciated that the amount is also a function of other variables such as the location and number of layers in which the compound is located, the solvent used, and film dimensions. Thus, it is desirable to have enough laydown of the compound in order to obtain the speed improvement. Suitably, there is present sufficient laydown to achieve an improvement of at least 0.05, and desirably at least 0.10 and even 0.25 stops or more.

Where the compound is present in a sensitized layer, the ratio of compound to silver is suitably at least 0.1 mmol of compound per mol of silver halide and, more preferably, at least 1.0 mmol of compound per mol of silver halide and, most preferably, at least 2.0 mmol per mol of silver halide. When coated in a non-silver containing layer, the laydown of the compound is suitably at least $3\times10^{-5}$ mol/m$^2$ or greater, or more preferably, at least 0.0001 mol/m$^2$ or greater.

The following are examples of compounds, along with the corresponding ClogP values, that are useful in this invention:

A:
(6.91)

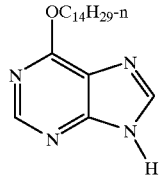

B:
(6.69)

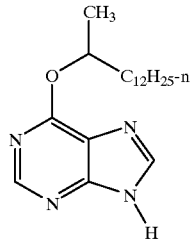

C:
(6.69)

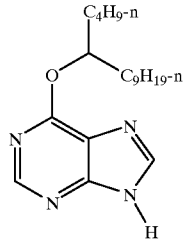

D:
(6.50)

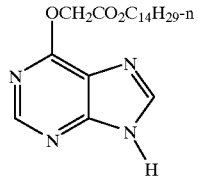

E:
(6.37)

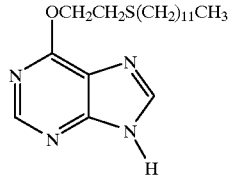

-continued
F:
(8.53)
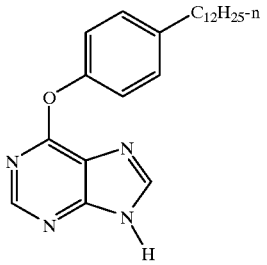
G:
(7.21)
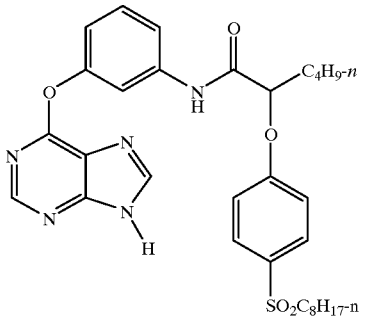
H:
(6.65)
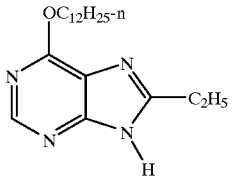
I:
(6.92)
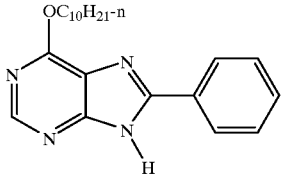
J:
(8.32)
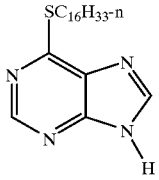
K:
(6.76)
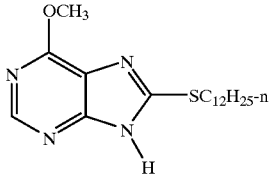
-continued
L:
(7.78)
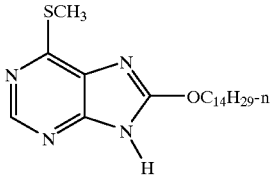
M:
(7.00)
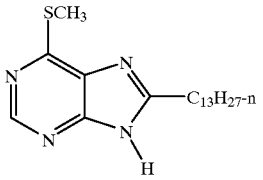
N:
(6.27)
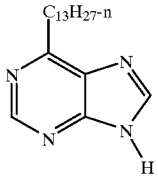
O:
(7.19)
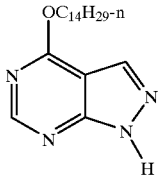
P:
(7.47)
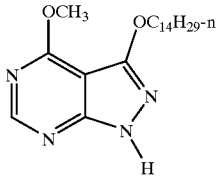
Q:
(6.49)
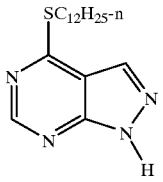
R:
(7.27)
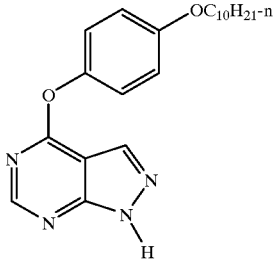

-continued
S:
(7.09)
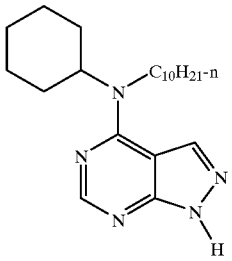
T:
(8.30)
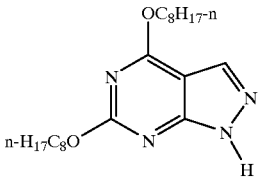
U:
(7:45)
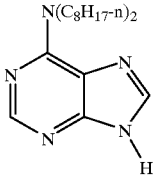
V:
(7.33)
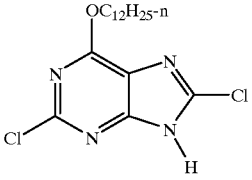
W:
(7.43)
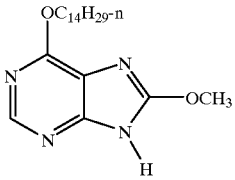
X:
(7.84)
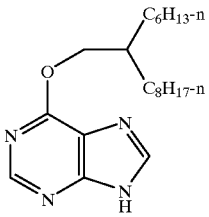
-continued
Y:
(7.97)
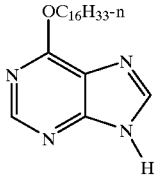
Z:
(9.03)
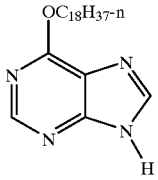
AA:
(6.21)
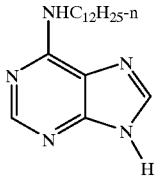
AB:
(6.98)
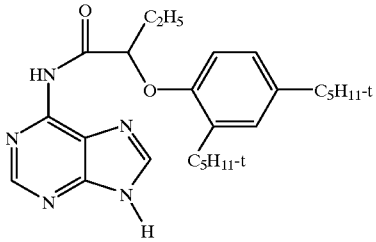
AC:
(7.09)
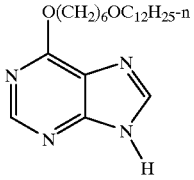
AD:
(8.19)
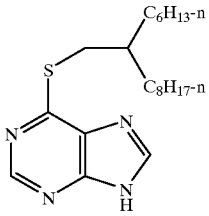
AE:
(8.30)
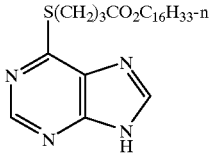

-continued
AF:
(9.36)
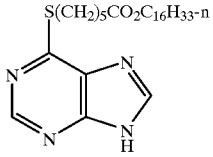
AG:
(7.45)
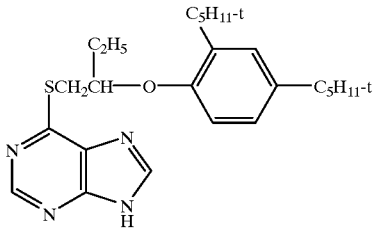
AH:
(8.17)
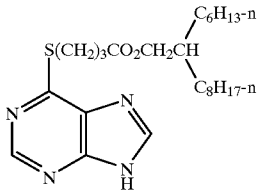
AI:
(6.66)
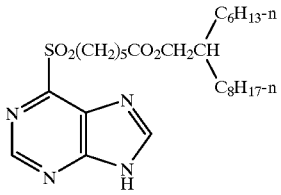
AJ
(9.35)
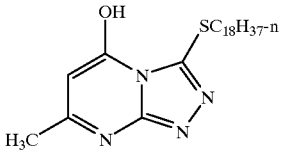
AK:
(10.68)
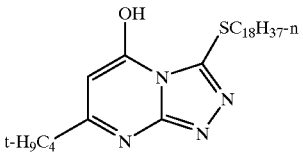
AL:
(7.41)
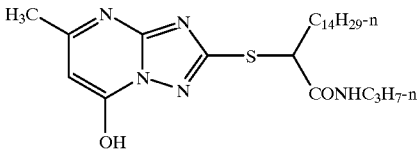
-continued
AM:
(8.11)
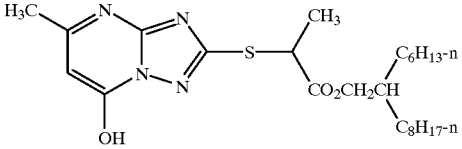
AN:
(10.49)
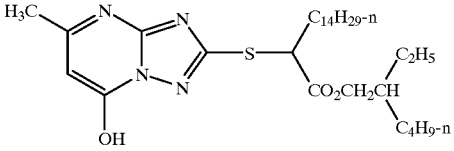
AO:
(7.75)
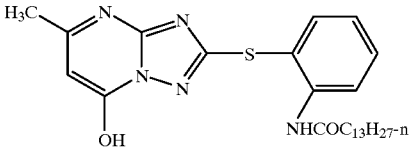
AP:
(6.59)
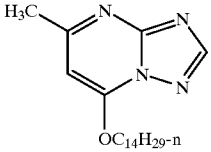
AQ:
(7.52)
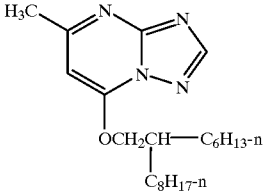
AR:
(8.57)
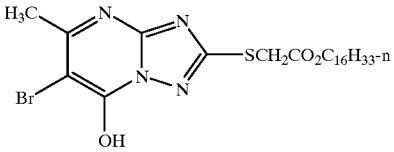
AS:
(6.94)
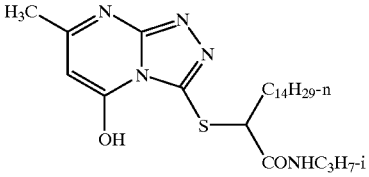
AT:
(6.70)
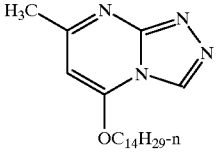

-continued
AU:
(9.68)
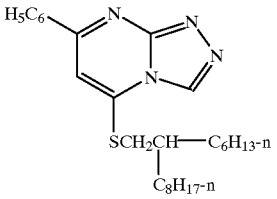
AV:
(7.90)
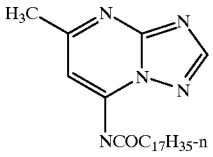
AW:
(8.11)
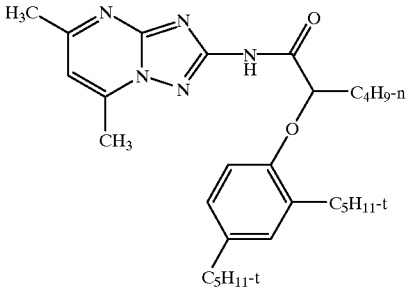
AX:
(8.37)
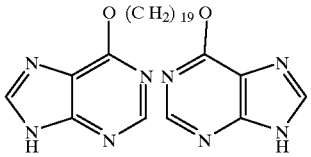
AY:
(8.35)
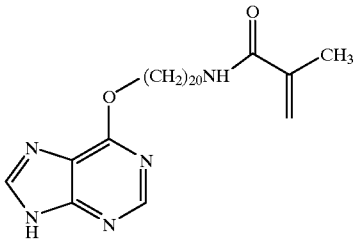
(2:1:1 by weight copolymer with styrene and n-butyl acrylate)
AZ:
(11.80)
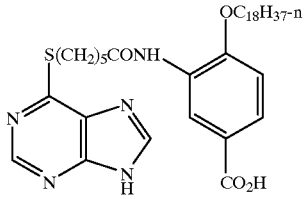
-continued
BA:
(7.82)
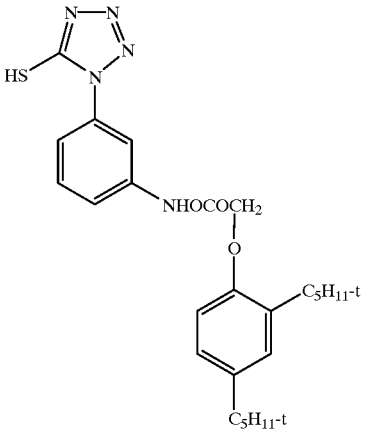
BB:
(7.99)
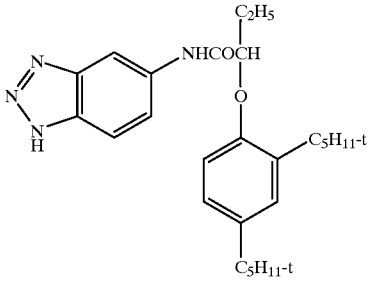
BC:
(8.94)
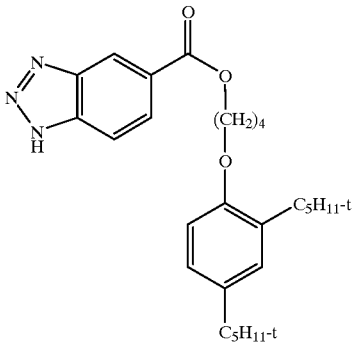
BD:
(9.04)
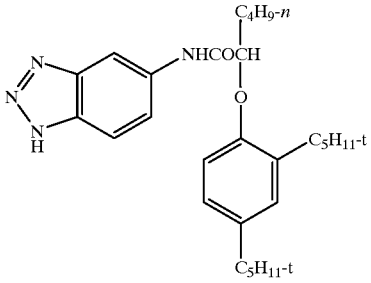

-continued
BE:
(10.10)
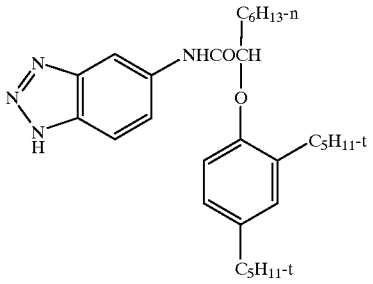
BF:
(11.18)
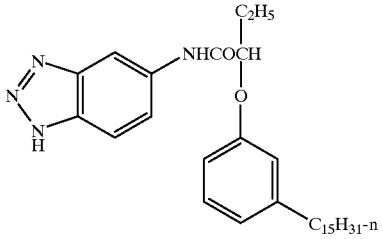
BG:
(10.66)
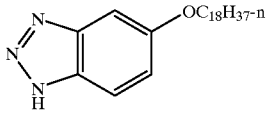
BH:
(11.85)
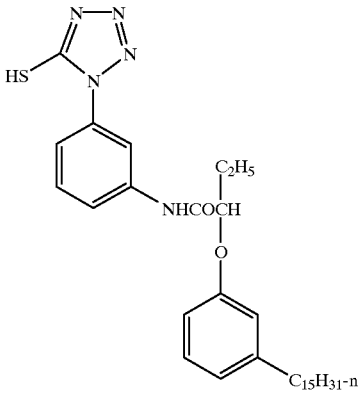
BI:
(7.91)
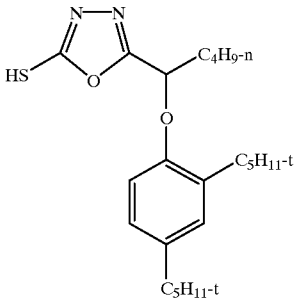
-continued
BJ:
(8.23)
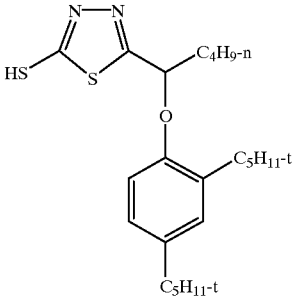
BK:
(8.44)
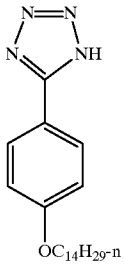
BL:
(12.07)
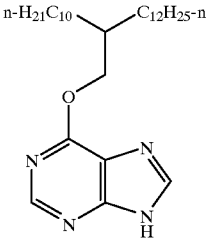
BM:
(10.23)
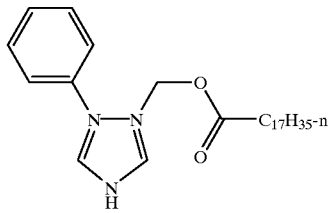
BN:
(7.76)
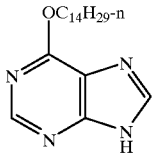
BO:
(9.61)
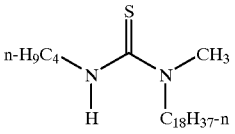

-continued

BP:
(6.7)

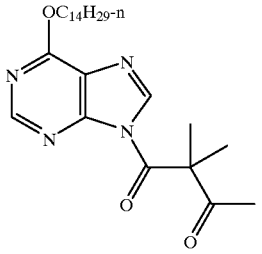

BQ:
(7.84)

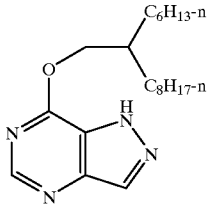

BR:
(10.23)

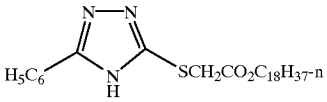

The materials of the invention can be added to a mixture containing silver halide before coating or, more suitably, be mixed with the silver halide just prior to or during coating. In either case, additional components like couplers, doctors, surfactants, hardeners and other materials that are typically present in such solutions may also be present at the same time. The materials of the invention are not water-soluble and cannot be added directly to the solution. They may be added directly if dissolved in an organic water miscible solution such as methanol, acetone or the like or more preferably as a dispersion. A dispersion incorporates the material in a stable, finely divided state in a hydrophobic organic solvent (often referred to as a coupler solvent or permanent solvent) that is stabilized by suitable surfactants and surface active agents usually in combination with a binder or matrix such as gelatin. The dispersion may contain one or more permanent solvents that dissolve the material and maintain it in a liquid state. Some examples of suitable permanent solvents are tricresylphosphate, N,N-diethyllauramide, N,N-dibutyllauramide, p-dodecylphenol, dibutylphthalate, di-n-butyl sebacate, N-n-butylacetanilide, 9-octadecen-1-ol, ortho-methylphenyl benzoate, trioctylamine and 2-ethylhexylphosphate. Permanent solvents can also be described in terms of physical constants such as alpha, beta and pi* as defined by M. J. Kamlet, J-L. M. Abboud, M. H. Abraham and R. W. Taft, J. Org Chem, 48, 2877(1983). The preferred permanent solvents used with the materials of the invention are those with ClogP of 5.0 or greater and beta values of 0.4 or greater or more preferably, beta values of 0.5 or greater. Preferred classes of solvents are carbonamides, phosphates, alcohols and esters. When a solvent is present, it is preferred that the weight ratio of compound to solvent be at least 1 to 0.5, or most preferably, at least 1 to 1. The dispersion may require an auxiliary coupler solvent initially to dissolve the component but this is removed afterwards, usually either by evaporation or by washing with additional water. Some examples of suitable auxiliary coupler solvents are ethyl acetate, cyclohexanone and 2-(2-butoxyethoxy)ethyl acetate. The dispersion may also be stabilized by addition of polymeric materials to form stable latexes. Examples of suitable polymers for this use generally contain water-solubilizing groups or have regions of high hydrophilicity. Some examples of suitable dispersing agents or surfactants are Alkanol XC or saponin. The materials of the invention may also be dispersed as an admixture with another component of the system such as a coupler or an oxidized developer scavenger so that both are present in the same oil droplet. It is also possible to incorporate the materials of the invention as a solid particle dispersion; that is, a slurry or suspension of finely ground (through mechanical means) compound. These solid particle dispersions may be additionally stabilized with surfactants and/or polymeric materials as known in the art. Also, additional permanent solvent may be added to the solid particle dispersion to help increase activity.

The sensitivity of the human eye is greatest to green light and so, the compounds of the invention are most useful when located in the green record (the layer whose maximum spectral sensitivity to light falls between 500 and 600 nm). The following magenta couplers are particularly beneficial when used in conjunction with the nitrogen heterocycles of the invention:

M-1:

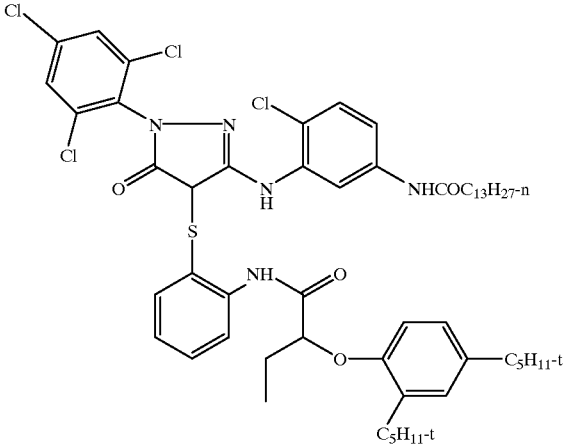

M-2:

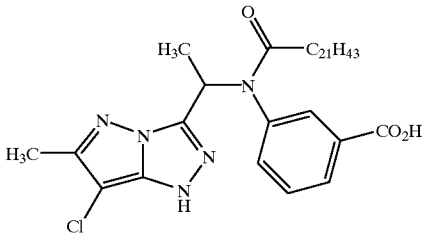

-continued
M-3:
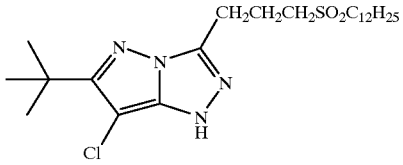
M-4:
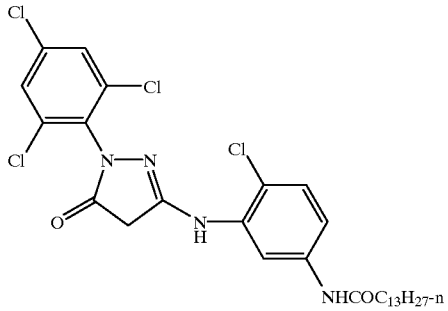
M-5:
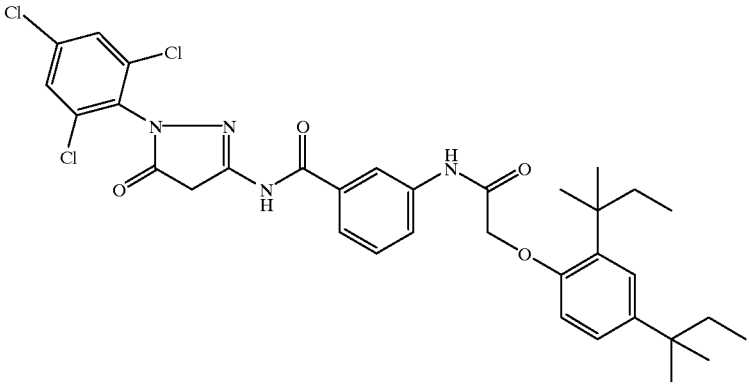
M-6:
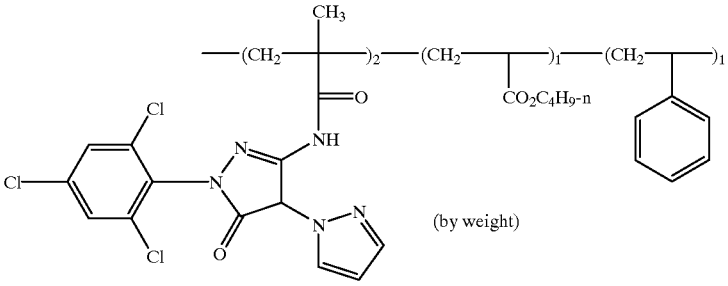
M-7:
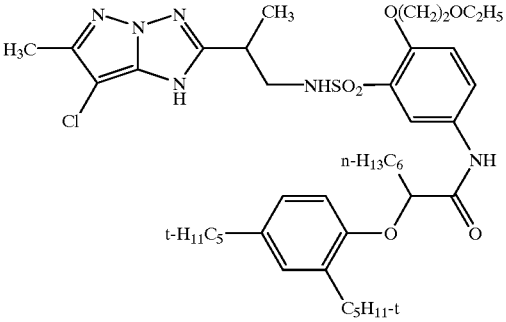
M-8:
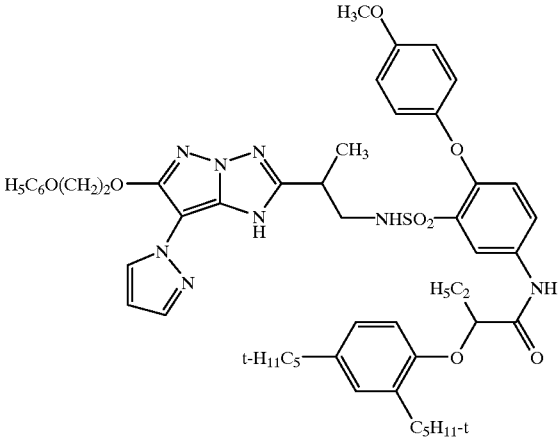

-continued
M-9:
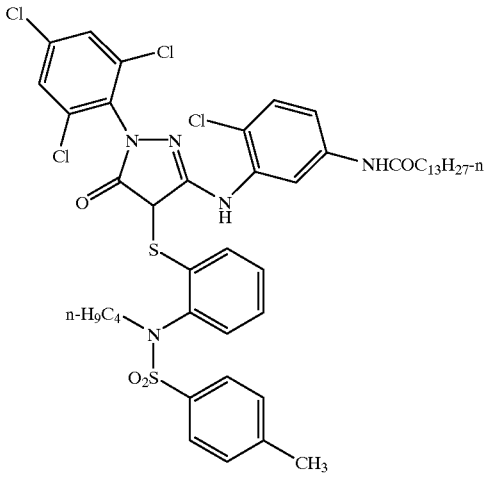
M-10:
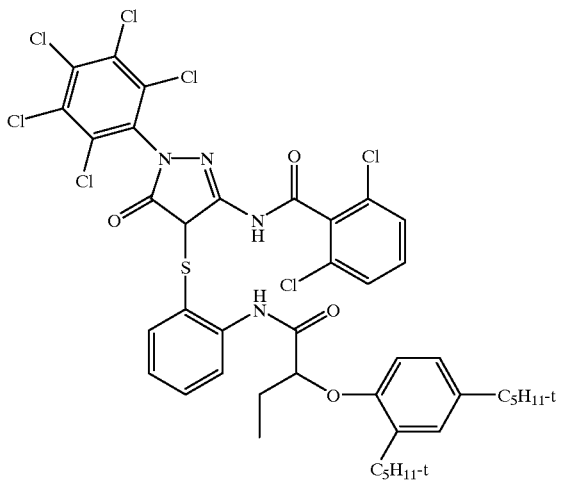
M-11:
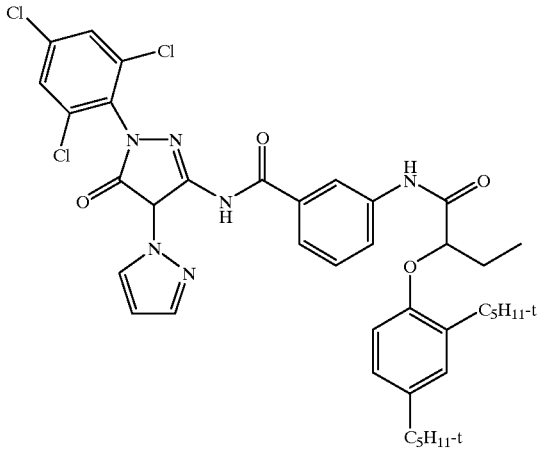
M-12:
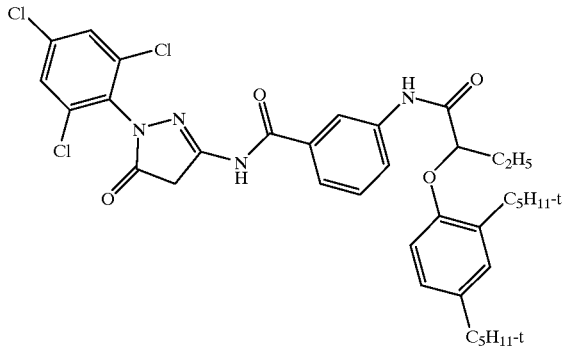
The following green sensitizing dyes are also particularly beneficial when used in combination with the nitrogen heterocycles of the invention:
GSD-1:
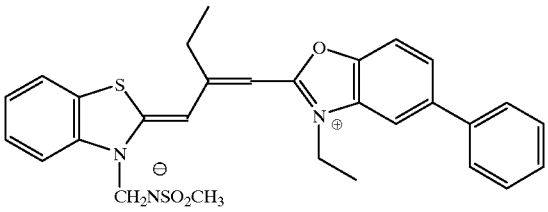
GSD-2:
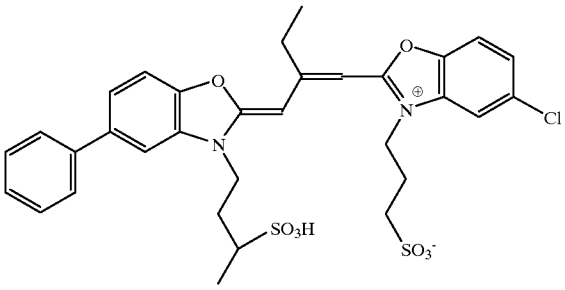
-continued
GSD-3:
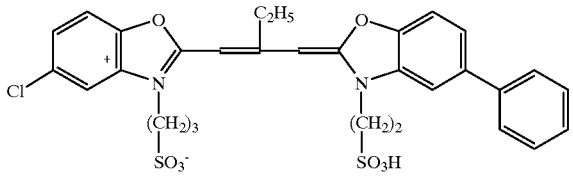
GSD-4:
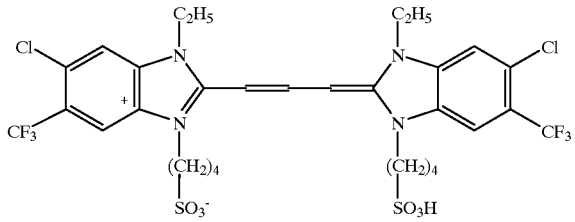

-continued

GSD-5:

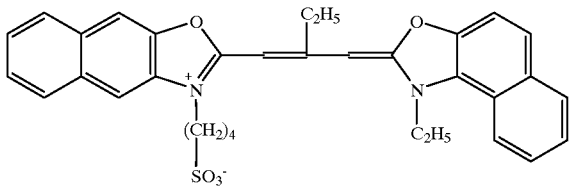

GSD-6:

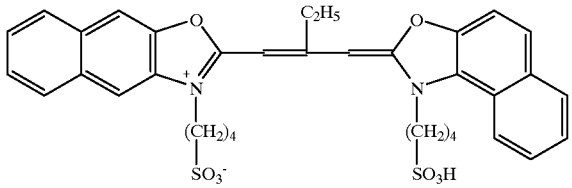

GSD-7:

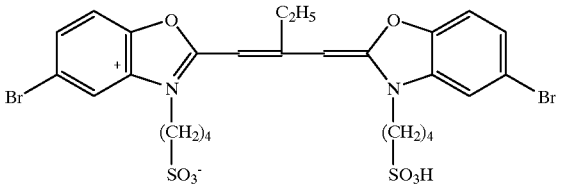

GSD-8:

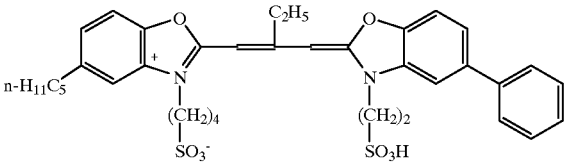

GSD-9:

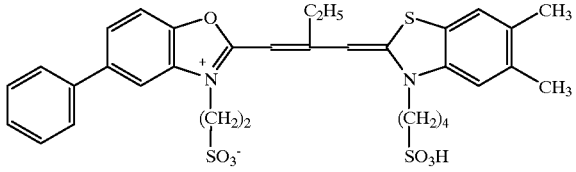

GSD-10:

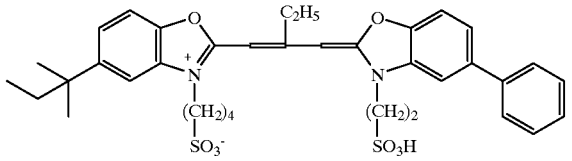

GSD-11:

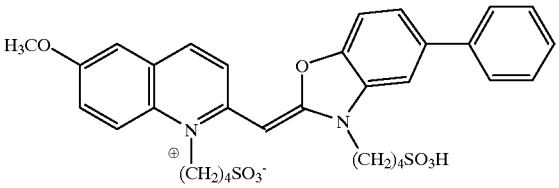

The type of light sensitive silver halide emulsion used in the layer that contains the compound useful in the invention may be important to obtain the desired increase in light sensitivity. The silver halide emulsion is suitably a silver iodobromide emulsion, meaning an emulsion that is low in chloride. By low in chloride, it is meant that there should be no more than 20 mol %. More suitably, there is present in the layer no more than 10 mol % chloride, and typically no more than 1 mol % chloride. The emulsion suitably contains at least 0.01 mol % iodide, or more preferably, at least 0.5 mol % iodide or most preferably, at least 1 mol % iodide. The benefit of the increase in light sensitivity is most apparent in combination with larger sized emulsions that are associated with increased granularity. Thus, it is preferred that the compounds of the invention are used with emulsions that have an equivalent circular diameter of at least 0.6 micrometer, or more preferably, at least 0.8 micrometer, or most preferably, at least 1.0 micrometer. In addition, the benefit of the invention is greatest in origination materials such as color negative or color reversal materials since they require higher sensitivity to light (because of the variable lighting conditions in natural scenes) and low granularity (due to high magnification) relative to color print materials for which exposure conditions are carefully controlled and which are viewed directly under low magnification conditions.

The compounds of the invention are also particularly useful when used in film elements that contain low overall silver levels. Thus, films containing 9 g/m$^2$ of total silver or less, or more preferably 5.4 g/m$^2$ or less or even 4.3 g/m$^2$ or less benefit from the use of the compounds of the invention.

In order to control and maintain granularity over a wide exposure range, it is a common practice to divide an individual color record into separate layers, each containing silver halide emulsions of different degree of sensitivity to the same color of light. While the compound of the invention is most useful in the most light sensitive layer, it can be used in more than one record that is sensitive to the same color of light. For example, in a color record that is split into three layers of different relative sensitivity; fast (F), mid (M) or slow (S), the compound can be used in each layer only or in any combination; i.e. F+M, F+M+S, F+S, etc. It is not necessary that these layers be adjacent; that is, they may have interlayers or even imaging layers that are sensitive to other colors located between them. In addition, although the most light sensitive layer is typically located in the film structure closest to the exposure source and farthest from the support, the compounds of the invention allow for alternative locations of the layers; for example, a more light sensitive layer containing the compound of the invention may be located below (farther from the exposing source) than a less sensitive layer. It is also possible to use the compounds of the invention in more than one color record at a time.

Moreover, when a number of layers of the same spectral sensitivity but of differing degrees of sensitivity to light are used, it is known that overall granularity can be minimized by using a smaller molar amount of dye-forming coupler than silver in the layers of higher sensitivity. Thus, it is preferred that the layers containing the compound of the invention additionally contain less than a stoichiometric amount of total dye forming coupler(s) relative to the amount of silver contained in the same layer. A suitable molar ratio of dye-forming coupler(s) to silver in the layer containing the compound of the invention would be less than 0.5. Most preferred would be a ratio of 0.2 or even 0.1 or less.

It is known that film elements can contain silver halide emulsions in one layer that have maximum sensitivities that are separated or shifted from emulsions in other layers that are sensitive to the same color of light (for example, a layer containing an emulsion with maximum sensitivity at ~530 nm whereas another layer contains a different green light sensitive emulsion which is most sensitive at ~550 nm) are useful for increasing the amount of interimage and improving color reproduction. The layer containing the emulsions with shifted sensitivities may not contain any image couplers at all, but rather only inhibitor releasing couplers (DIRs or DIARs (Development Inhibitor Anchimeric Releasing couplers)) or colored masking couplers. The compounds of the invention are particularly useful in this type of application since they allow for the improved color reproduction while maintaining or increasing speed of the element.

The desired effect of the invention can also be obtained when the compound of the invention is located in a non-silver containing light insensitive layer, especially one that is preferably adjacent to an imaging layer, particularly the most sensitive layer of a multilayer record. Preferably, the light insensitive layer is an interlayer located between two light sensitive imaging layers. The interlayer can be located between two imaging layers sensitive to the same color or different. It is also possible that the interlayer containing the compound is located between an imaging layer and an antihalation layer. The interlayer may also contain additional materials such as oxidized developer scavengers or colored organic filter dyes. It is preferred for this embodiment that the compound be located in a non-silver containing interlayer between the blue and green sensitive color records or a non-silver containing interlayer between the green and red sensitive color records. The non-light sensitive layer containing a compound of the invention cannot additionally contain either metallic silver or any type of finely divided silver salt.

The compounds of the invention tend to increase the Dmin of the emulsion layer in which they are coated. Thus, it is often highly advantageous to use the compounds of the invention in combination with any of the antifoggants or scavengers known in the art to be useful in controlling Dmin or fog. Specific examples of scavengers for oxidized developers would be 2,5-di-t-octylhydroquinone, 2-(3,5-bis-(2-hexyl-dodecylamido)benzamido)-1,4-hydroquinone, 2,4-(4-dodecyloxybenzenesulfonamido)phenol, 2,5-dihydroxy-4-(1-methylheptadecyl)benzenesulfonic acid or 2,5-di-s-dodecylhydroquinone. Specific examples of useful antifoggants are compounds AF-1 to AF-8 whose structures are shown below as well as 4-hydroxy-6-methyl-1,3,3a,7-tetraazaindene:

AF-1:

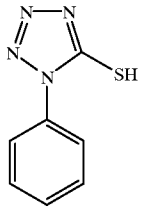

AF-2:

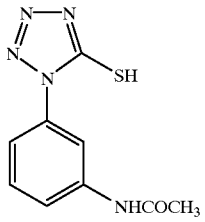

-continued

AF-3:

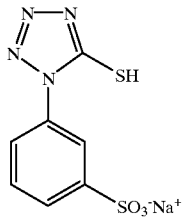

AF-4:

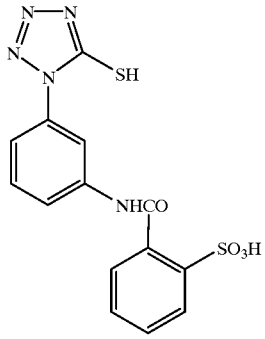

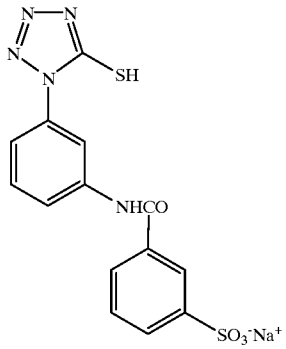

AF-5:

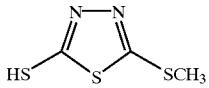

AF-6:

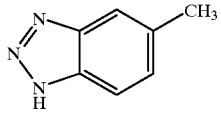

AF-7:

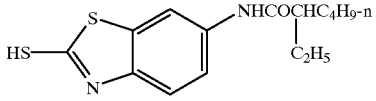

AF-8:

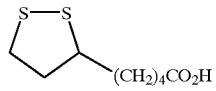

If the compounds of the invention have a suitable N—H, O—H or S—H group, the hydrogen may be optionally replaced with a group that is removed in a non-imagewise fashion during the development step to regenerate the original N—H, O—H or S—H group. This offers the advantage of minimizing or avoiding undesirable interactions of the compound with the silver halide emulsion before processing. In this case, it is the ClogP of the unblocked compound that is important and should be calculated with the hydrogen present and without the blocking group. Any of the temporary blocking groups known in the art to decompose in the developer in a non-imagewise manner can be used for this purpose. Particularly useful are those blocking groups that rely on some specific component of the developer solution to cause decomposition and regeneration of the original substituent. One example of this kind of blocking group, which relies on the hydroxylamine present in the developer, is described in U.S. Pat. No. 5,019,492.

Unless otherwise specifically stated or when the term "group" is used, it is intended throughout this specification, when a substituent group contains a substitutable hydrogen, it is intended to encompass not only the substituent's unsubstituted form, but also its form further substituted with any group or groups as herein mentioned, so long as the group does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine, iodine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy)propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)hexanamido, alpha-(4-hydroxy-3-t-butylphenoxy)tetradecanamido, 2-oxopyrrolidin-1-yl, 2-oxo-5-tetradecylpyrrolin-1yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecylphenylcarbonylamino, p-tolylcarbonylamino, N-methylureido, N,N-dimethylureldo, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylurcido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfonyl, 2-ethylhexylsulfonyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

To control the migration of various components, it may be desirable to include a high molecular weight or polymeric backbone containing hydrophobic or "ballast" group in molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

As used herein, the term "color photographic element" means any element containing a light-sensitive silver halide emulsion layer containing an image dye-forming coupler. They can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer. A single color element may comprise a combination of couplers in one or more common layers which upon processing together form a monocolor, including black or gray, (so-called chromogenic black and white) dye image.

A typical color photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, or subbing layers.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure*, Item No. 36544 referenced above, is updated in the September 1996 *Research Disclosure*, Item No. 38957. Certain desirable photographic elements and processing steps, including those useful in conjunction with color reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, or color correction.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777. and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123;

5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912, 265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474; 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632, 345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151, 343, and 5,234,800.

It may be useful to use a combination of couplers any of which may contain known ballasts or coupling-off groups such as those described in U.S. Pat. Nos. 4,301,235; 4,853, 319 and 4,351,897. The coupler may contain solubilizing groups such as described in U.S. Pat. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. Nos. 4,163, 669; 4,865,956; and 4,923,784, may be useful. Also contemplated is use of the compositions in association with nucleating agents, development accelerators or their precursors (UK Patent 2,097,140; UK. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIRs). DIRs useful in conjunction with the compositions of the invention are known in the art and examples are described in U.S. Pat. Nos. 3,137,578; 3,148,022; 3,148, 062; 3,227,554; 3,384,657; 3,379,529; 3,615,506; 3,617, 291; 3,620,746; 3,701,783; 3,733,201; 4,049,455; 4,095, 984; 4,126,459; 4,149,886; 4,150,228; 4,211,562; 4,248, 962; 4,259,437; 4,362,878; 4,409,323; 4,477,563; 4,782, 012; 4,962,018; 4,500,634; 4,579,816; 4,607,004; 4,618, 571; 4,678,739; 4,746,600; 4,746,601; 4,791,049; 4,857, 447; 4,865,959; 4,880,342; 4,886,736; 4,937,179; 4,946, 767; 4,948,716; 4,952,485; 4,956,269; 4,959,299; 4,966, 835; 4,985,336 as well as in patent publications GB 1,560, 240; GB 2,007,662; GB 2,032,914; GB 2,099,167; DE 2,842,063, DE 2,937,127; DE 3,636,824; DE 3,644,416 as well as the following European Patent Publications: 272, 573; 335,319; 336,411; 346,899; 362,870; 365,252; 365, 346; 373,382; 376,212; 377,463; 378,236; 384,670; 396, 486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) that also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

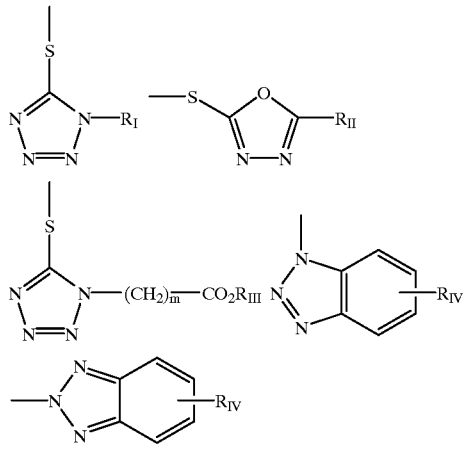

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. Nos. 4,438,193; 4,618,571) and groups that combine the features described above. It is typical that the timing group is of one of the formulas:

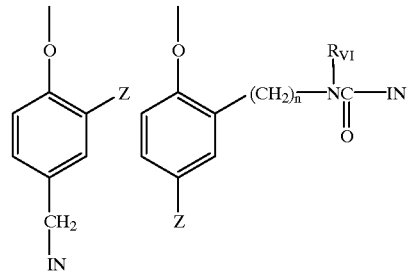

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers that may be included in photographic light sensitive emulsion layer include, but are not limited to, the following:

D1

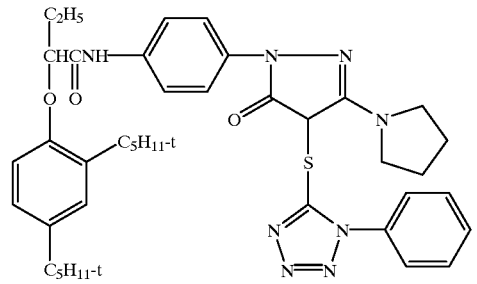

D2

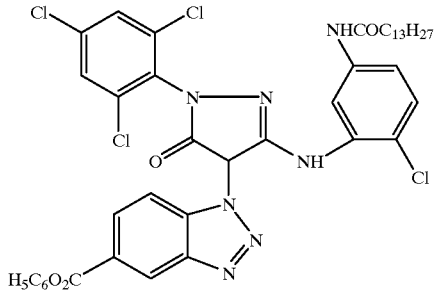

-continued
D3
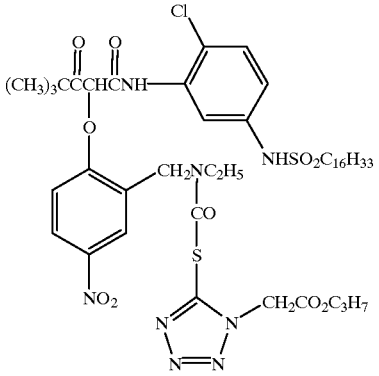
D4
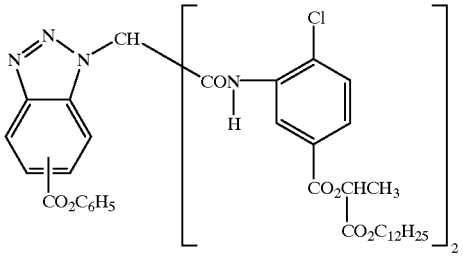
D5
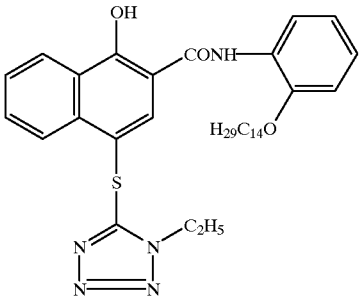
D6
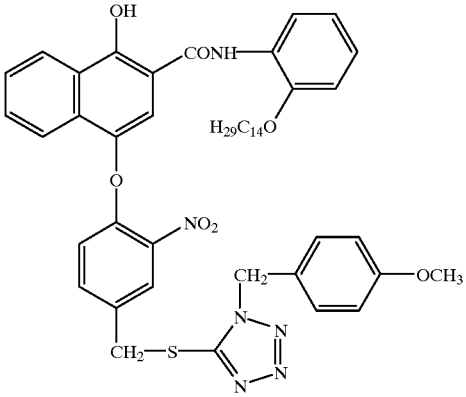
-continued
D7
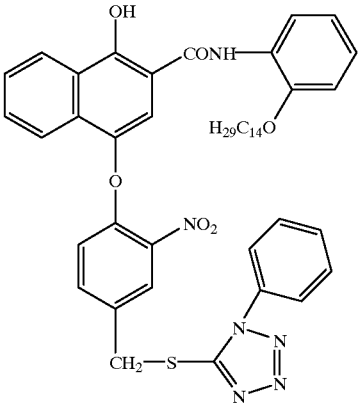
D8
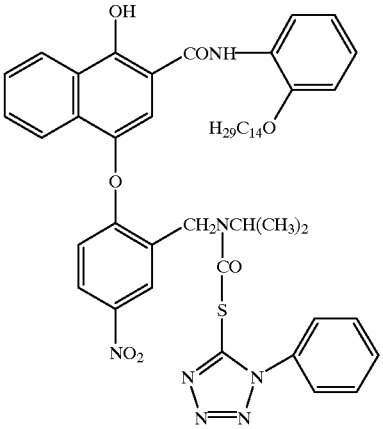
D9
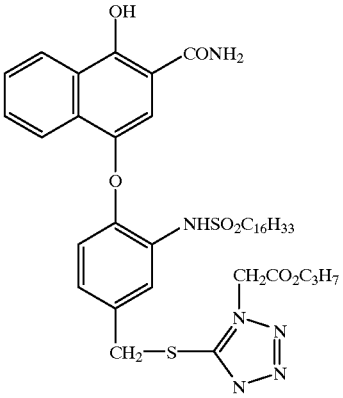

-continued

D10

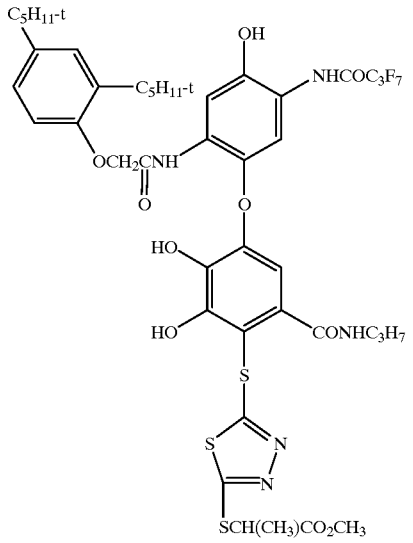

D11

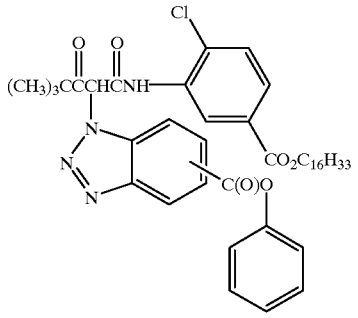

D12

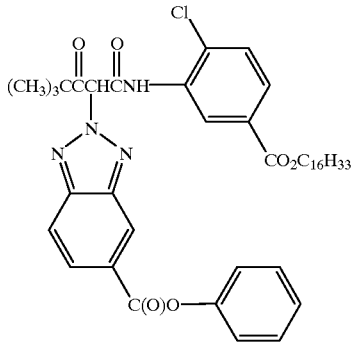

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). The major faces of the tabular grains can lie in either {111} or {100} crystal planes. Specifically contemplated tabular grain emulsions are those in which greater than 50 percent of the total projected area of the emulsion grains are accounted for by tabular grains having a thickness of less than 0.3 micrometer (0.5 micrometer for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECDs seldom exceed about 4 micrometers. Since both photographic speed and granularity increase with increasing ECDs, it is generally preferred to employ the smallest tabular grain ECDs compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.07 micrometer) tabular grains. Tabular grain thicknesses typically range down to about 0.02 micrometer. However, still lower tabular grain thicknesses are contemplated. For example, Daubendiek et al. U.S. Pat. No. 4,672,027 reports a 3 mol percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616. Tabular grain emulsions consisting predominantly of silver chloride are useful and are described, for example, in U.S. Pat. Nos. 5,310,635; 5,320,938; and 5,356,764.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 and 4,173,320, Daubendick et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, 5,147,772, 5,147,773, 5,171,659 and 5,252,453, Black et al U.S. Pat. Nos. 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color-developing agent to reduce developable silver halide and oxidize the color developing agent. Oxidized color developing agent in turn reacts with the coupler to yield a dye.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions and may be processed, for example, in known color negative processes such as the Kodak C-41™ process as described in The British Journal of Photography Annual of 1988, pages 191–198. If a color negative film element is to be subsequently employed to generate a viewable projection print as for a motion picture, a process such as the Kodak ECN-2™ process described in the H-24 Manual available from Eastman Kodak Co. may be employed to provide the color negative image on a transparent support. Color negative development times are typically 3 minutes 15 seconds. The photographic element of the invention can be incorporated into exposure structures intended for repeated use or exposure structures intended for limited use, variously referred to by names such as "single use cameras", "lens with film", or "photosensitive material package units".

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6™ process. Alternatively, a direct positive emulsion can be employed to obtain a positive image.

The above emulsions are typically sold with instructions to process using the appropriate method such as the mentioned color negative (Kodak C-41) or reversal (Kodak E-6) process.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl) aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Of the above, developers based on 4-amino-3-methyl-N-ethyl-N-(2-hydroxyethyl)aniline and 4-amino-3-methyl-N-ethyl-N-(2-methanesulfonamidoethyl)aniline are especially preferred. Moreover, because the compounds of the invention give increased light sensitivity, they are especially useful in processes that have shortened development times. In particular, the film elements of the invention can be processed with development times of less than 3.25 minutes or even less than 3 minutes or in extreme cases, even less than 120 seconds.

Development is usually followed by the conventional steps of bleaching, fixing, or bleach-fixing, to remove silver or silver halide, washing, and drying.

The entire contents of the patents and other publications referred to in this specification are incorporated herein by reference.

Synthesis Example

Synthesis of 6-(tetradecyloxy)purine (A)

Potassium tert-butoxide (284.50 g, 2.54 mol) was added to a stirred solution of tetradecanol (271.75 g, 1.27 mol) in tetrahydrofuran (51) under an atmosphere of nitrogen. A thick precipitate formed and the reaction became slightly warm. The reaction was stirred for 0.5 h and then 6-chloropurine (196.20 g, 1.27 mol) was added and the reaction stirred for 0.25 hr before being heated at reflux for 3 h. The reaction was allowed to cool, and then the solvent was removed in vacuo. First water (4 l) then concentrated hydrochloric acid (135 ml, 1.35 mol) was added to the residue and the suspension was stirred for 0.5 h after which time it was still acidic. The suspension was neutralized with saturated sodium hydrogen carbonate solution. After stirring vigorously for 0.5 h the solid was removed by filtration and recrystallized from methanol (about 4.5 l). A small amount of solid did not dissolve. The suspension was allowed to cool to room temperature but was not cooled further. This gave a white solid that was recrystallized once more from methanol (about 4.5 l). Again, a small amount of solid did not dissolve so it was removed whilst the methanol was still hot. This solid was insoluble in water and common organic solvents (acetone, methanol, tetrahydrofuran, ethyl acetate and dichloromethane). The suspension was allowed to cool to room temperature. Filtration and drying at oil pump vacuum (approximately 300 ml of methanol removed) gave a white solid (325.90 g).

5-Amidobenzotriazoles were prepared by acylation of commercially available 5-aminobenzotriazole using methods such as those described in JP 60-133061A2, GB 2011391 and NL 6414144. 1-(3-Amidophenyl)-5-mercaptotetrazoles were prepared by acylation of 1-(3-aminophenyl)-5-mercaptotetrazole as described in FR 1445324. 4,5-Disubstituted-1,2,3-triazoles were prepared via the procedure given in Tetrahedron, 1973, 29(21), 3271–3283.

Photographic Examples

Formulas for the identified compounds are provided at the end of all of the examples.

EXAMPLE 1

Monochrome films demonstrating the invention were produced by coating the following layers over a gelatin pad of 2.7 g/m$^2$ on a cellulose triacetate film support (coverages are in grams per meter squared, emulsion sizes as determined by the disc centrifuge method and are reported in diameter x thickness in micrometers):

Sample 1

Layer 1 (Slow): gelatin at 1.188; magenta coupler M-1 at 0.287; yellow colored magenta masking coupler MC-2 at 0.076; a blend of two green sensitized silver iodobromide emulsions at a total of 0.875; $Na_3Au(S_2O_3)_2.2H_2O$ at $7.8\times10^{-7}$; and 4-hydroxy-6-methyl-1,3,3a,7-tetraazaindene at $1.42\times10^{-5}$.

Layer 2 (Mid): gelatin at 1.566; M-1 at 0.058; MC-2 at 0.108; DIR-7 at 0.0108; a green sensitized iodobromide emulsion at 0.972; a 1:1 mixture (by weight) of $(NH_4)_2PdCl_4$:ethylenediamine at $7.8\times10^{-7}$; and 4-hydroxy-6-methyl-1,3,3a,7-tetraazaindene at $1.58\times10^{-5}$.

Layer 3 (Fast); gelatin at 2.7; M-1 at 0.084; DIR-7 at 0.003; a green sensitized iodobromide emulsion at 1.30; and $Na_3Au(S_2O_3)_2.2H_2O$ at $4.0\times10^{-8}$.

Layer 4 (Overcoat): gelatin at 2.7 and bis-vinylmethylsulfonemethylether at 0.22.

Sample 2 was prepared like MC-1 except 0.058 of N,N-dibutyllauramide (added as a dispersion in gel) was added to Layer 3. Sample 3 had 0.0875 of N,N-dibutyllauramide (dispersion in gel) added to Layer 3. Sample 4 had 0.029 of inventive compound X (dispersed in twice its own weight of N,N-dibutyllauramide) added to Layer 3. Sample 5 had 0.044 of inventive compound X (dispersed in twice its own weight of N,N-dibutyllauramide) added to Layer 3.

These films were exposed and processed in the KODAK FLEXICOLOR™ (C-41) process as described in *British Journal of Photography Annual,* 1988, pp 196–198 except the temperature of the developer was 32.2° C. and the time of development was 2 minutes. Relative speed or light sensitivity (given in terms of fraction of a stop (1 stop is a doubling of relative exposure)) was determined by comparing the exposure point +0.15 density units above Dmin to the check position without addenda under the given exposure condition. Comparing Sample 4 to Samples 1 and 2 and comparing Sample 5 to Samples 1 and 3, the results shown in Table 1 clearly demonstrate the increase in light sensitivity in the presence of a compound of the invention.

TABLE 1

Monochrome Results

| Sample | Comp/Inv | Addenda (g/m$^2$) | Green Dmin | Relative Green Speed |
|---|---|---|---|---|
| 1 | Comp | None | 0.396 | 0 (check) |
| 2 | Comp | N,N-dibutyllauramide (0.058) | 0.390 | 0.16 |
| 3 | Comp | N,N-dibutyllauramide (0.0875) | 0.384 | 0.31 |
| 4 | Inv | Inventive compound X (0.029) | 0.392 | 0.51 |
| 5 | Inv | Inventive compound X (0.044) | 0.394 | 0.49 |

Multilayer films in three formats (ML-A, ML-B and ML-C) demonstrating the principles of this invention were produced by coating the following layers on a cellulose triacetate film support (coverage are in grams per meter squared, emulsion sizes as determined by the disc centrifuge method and are reported in Diameter×Thickness in micrometers). Surfactants, coating aids, emulsion addenda, sequestrants, thickeners, lubricants, matte and tinting dyes were added to the appropriate layers as is common in the art.

EXAMPLE 2

Sample ML-A-1

Layer 1 (Antihalation layer): black colloidal silver sol at 0.135; ILS-1 at 0.162, DYE-1 at 0.018; DYE-2 at 0.025; DYE-3 at 0.035; UV-1 at 0.060; UV-2 at 0.015; and gelatin at 2.05.

Layer 2 (Slow cyan layer): a blend of two red sensitized (both with a mixture of RSD-1 and RSD-2) tabular silver iodobromide emulsions: (i) 0.66×0.12, 4.1 mol % I at 0.302 (ii) 0.55×0.08, 1.5 mol % I at 0.464; cyan dye-forming coupler C-1 at 0.535; DIR coupler DIR-1 at 0.027; bleach accelerator releasing coupler B-1 at 0.057; masking coupler MC-1 at 0.032; and gelatin at 1.68.

Layer 3 (Mid cyan layer): a blend of two red sensitized (same as above) tabular silver iodobromide emulsions: (i) 0.122×0.11, 4.1 mol % I at 0.194 (ii) 1.07×0.11, 4.1 mol % I at 0.238; cyan coupler C-1 at 0.171; DIR-1 at 0.019; MC-1 at 0.032; B-1 at 0.008; and gelatin at 1.08.

Layer 4 (Fast cyan layer): a red sensitized (same as above) tabular silver iodobromide emulsion (1.33×0.12, 4.1 mol % I) at 0.594; C-1 at 0.184; DIR-1 at 0.027; MC-1 at 0.022; and gelatin at 0.918.

Layer 5 (Interlayer): ILS-1 at 0.086 and gelatin at 0.540.

Layer 6 (Slow magenta layer): a blend of two green sensitized (both with a mixture of GSD-1 and GSD-2) silver iodobromide emulsions: (i) 0.81×0.12, 2.6 mol % iodide at 0.346 and (ii) 0.55×0.08, 1.5 mol % iodide at 0.130; magenta dye forming coupler M-1 at 0.270; MC-2 at 0.086; DIR-2 at 0.011; and gelatin at 1.08.

Layer 7 (Mid magenta layer): a blend of two green sensitized (same as above) tabular silver iodobromide emulsions (i) 1.22×0.11, 4.1 mol % I at 0.248 and (ii) 1.07×0.11, 4.1 mol % I at 0.248; M-1 at 0.124; MC-2 at 0.119; DIR-2 at 0.043; OxDS-1 at 0.016; and gelatin at 1.22.

Layer 8 (Fast magenta layer): a green sensitized tabular silver iodobromide (1.33×0.12, 4.1 mol % I) emulsion at 0.486; M-1 at 0.076; MC-2 at 0.054; B-1 at 0.003; DIR-2 at 0.015; OxDS-1 at 0.009; and gelatin at 1.02.

Layer 9 (Yellow filter layer): yellow filter dye YFD-1 at 0.054; ILS-1 at 0.086; and gelatin at 0.648.

Layer 10 (Slow yellow layer): a blend of three blue sensitized (all with a mixture of BSD-1 and BSD-2) tabular silver iodobromide emulsions (i) 0.55×0.08, 1.5 mol % I at 0.270 (ii) 0.0.77×0.14, 1.5 mol % I at 0.248 and (iii) 1.25×0.14, 4.1 mol % I at 0.400; yellow dye forming coupler Y-1 at 1.08; DIR-3 at 0.076; DIR-1 at 0.032; B-1 at 0.022; and gelatin at 1.879.

Layer 11 (Fast yellow layer): a blend of two blue sensitized (both with a mixture of BSD-1 and BSD-2) tabular silver iodobromide emulsions (i) 1.25×0.14, 4.1 mol % I at 0.108 (ii) 2.67×0.13, 4.1 mol % I at 0.378; Y-1 at 0.238; DIR-3 at 0.076; B-1 at 0.005; and gelatin at 0.810.

Layer 12 (Protective overcoat and UV filter layer): silver bromide Lippman emulsion at 0.216; UV-1 at a total of 0.108; gelatin at 1.242 and bis(vinylsulfonyl)methane hardener at 1.75% of total gelatin weight.

Sample ML-A-2 was prepared like ML-A-1 except that DIR-3 in Layers 10 and 11 was replaced with DIR-4 at 0.097.

Sample ML-A-3 was prepared like ML-A-1 except that CC-1 (dispersed in five times its weight in N,N-dibutyllauramide) was added to Layers 7 and 8 at 0.012.

Sample ML-A-4 was prepared like ML-A-2 except that CC-1 was added to Layers 7 and 8 at 0.012.

Sample ML-A-5 was prepared like ML-A-1 except that compound A (dispersed in five times its weight in N,N-dibutyllauramide) was added to Layers 7 and 8 at 0.0012. This represents a molar ratio of approximately 0.8 mmol of A per mol of silver in each layer.

Sample ML-A-6 was prepared like ML-A-2 except that compound A was added to Layers 7 and 8 at 0.0012. This represents a molar ratio of approximately 0.8 mmol of A per mol of silver in each layer.

Sample ML-A-7 was prepared like ML-A-1 except that compound A was added to Layers 7 and 8 at 0.012. This represents a molar ratio of approximately 8 mmol of A per mol of silver in each layer.

Sample ML-A-8 was prepared like ML-A-2 except that compound A was added to Layers 7 and 8 at 0.012. This represents a molar ratio of approximately 8 mmol of A per mol of silver in each layer.

These multilayer coatings were given the indicated stepped exposure (Neutral=all 3 colors; Green Only=WR74 filter) and processed in the KODAK FLEXICOLOR™ (C-41) process as described in *British Journal of Photography Annual,* 1988, pp 196–198. Relative speed or light sensitivity (given in terms of fraction of a stop) was determined by comparing the exposure point +0.15 density units above Dmin to the check position without addenda under the given exposure condition (neutral=all 3 layers exposed at same time; G Only=only the green layer exposed using an appropriate green WRATTEN™ 74 filter). A larger, more positive number implies increased speed; a negative number implies a loss in sensitivity. Granularity of the green layer in a neutral exposure was determined by the RMS method (see The Theory of the Photographic Process, $4^{th}$ Edition, T. H. James, pp 625–628) using a 48 micrometer aperture at the density 1.2 log exposure units from the speed point defined above.

TABLE 2

Multilayer ML-A Results

| Sample | Comp/ Inv | DIR in L10/L11 | Add-enda in L7/L8 - (mmol/ molAg) | Speed of Neutral vs check (stops) | Speed of G Only vs check (stops) | Granu-larity (× $10^3$) |
|---|---|---|---|---|---|---|
| ML-A-1 | Comp | DIR-3 | None | 0 (Check) | 0 (Check) | 15.7 |
| ML-A-2 | Comp | DIR-4 | None | 0 (Check) | 0 (Check) | 17.0 |
| ML-A-3 | Comp | DIR-3 | CC-1(8) | −0.83 | −0.73 | 12.6 |
| ML-A-4 | Comp | DIR-4 | CC-1(8) | −1.57 | −0.76 | 9.4 |
| ML-A-5 | Inv | DIR-3 | A (0.8) | 0.13 | 0.00 | 15.4 |
| ML-A-6 | Inv | DIR-4 | A (0.8) | 0.07 | 0.04 | 16.6 |
| ML-A-7 | Inv | DIR-3 | A (8) | 0.43 | 0.31 | 14.9 |
| ML-A-8 | Inv | DIR-4 | A (8) | 0.50 | 0.30 | 15.5 |

As demonstrated by the data in Table 2 for format ML-A, only the compound of the invention gives enhanced photographic response to light while maintaining desirable granularity. CC-1, which has a ClogP outside the scope of the invention, does not accomplish this result. The effect does not depend on the nature or type of the DIR used in other layers since the increase in speed is present with both DIR-3 or DIR-4 or even when only the green layer is exposed. Similar results were found when an additional imaging layer containing 0.216 of green sensitized silver iodobromide emulsion (maximum sensitivity at 530 nm) with DIR-8, DIR-9 or DIR-10 (each coated separately at 0.057 mmol/$m^2$) was substituted between Layers 8 and 9 of ML-A. Addition of 0.082 mmol/$m^2$ of inventive compound X (ratio mmol compound:mol silver=40.5) to this additional layer gave increased green speed of between 0.23 and 0.30 in each case while maintaining high interimage and low granularity.

EXAMPLE 3

Sample ML-B-1

Layer 1 (Antihalation layer): gelatin at 1.62, colloidal gray silver at 0.151; DYE-1 at 0.013; DYE-3 at 0.108; DYE-4 at 0.037; and UV-1 and UV-2 each at 0.076.

Layer 2 (Interlayer): gelatin at 0.54 and ILS-1 at 0.076.

Layer 3 (Slow cyan layer): a blend of two red sensitized (all with a mixture of RSD-1 and RSD-3) silver iodobromide emulsions: (i) a large sized iodobromide tabular grain emulsion (1.25×0.124, 4.1 mol % I) at 0.313, (ii) a smaller iodobromide tabular emulsion (0.74×0.12, 4.1 mol % I) at 0.266; cyan dye-forming coupler C-1 at 0.228; C-2 at 0.364; bleach accelerator releasing coupler B-1 at 0.081; masking coupler MC-1 at 0.032 and gelatin at 1.67.

Layer 4 (Mid cyan layer): a red sensitized (all with a mixture of RSD-1 and RSD-3) iodobromide tabular emulsion (2.25×0.125, 3.1 mol % I) at 1.177; C-2 at 0.211; DIR-5 at 0.011; DIR-6 at 0.011; ILS-1 at 0.011 and gelatin at 1.62.

Layer 5 (Fast cyan layer): a red sensitized (with a mixture of RSD-1 and RSD-3) iodobromide tabular emulsion (4.05×0.13, 3.7 mol % I) at 1.295; C-2 at 0.227; DIR-5 at 0.0.022; DIR-6 at 0.025; ILS-1 at 0.014 and gelatin at 1.49.

Layer 6 (Interlayer): ILS-1 at 0.076 and gelatin at 0.54.

Layer 7 (Slow magenta layer): a blend of two green sensitized (both with a mixture of GSD-1 and GSD-2) silver iodobromide tabular emulsions: (i) 0.88×0.12, 4.1 mol % iodide at 0.539 and (ii) 1.2×0.12, 4.1 mol % iodide at 0.336; magenta dye forming coupler M-1 at 0302; masking coupler MC-2 at 0.076 and gelatin at 1.188.

Layer 8 (Mid magenta layer): a green sensitized (with a mixture of GSD-1 and GSD-2) silver iodobromide tabular emulsion: (2.85×0.116, 3.6 mol % iodide) at 0.972; M-1 at 0.103; MC-2 at 0.086; DIR-7 at 0.011 and gelatin at 1.566.

Layer 9 (Fast magenta layer): a green sensitized (with a mixture of GSD-1 and GSD-2) silver iodobromide tabular emulsion (3.95×0.14, 3.6 mol % iodide) at 1.296; M-1 at 0.084; DIR-7 at 0.003 and gelatin at 1.62.

Layer 10 (Yellow filter layer): ILS-1 at 0.076; YFD-1 at 0.108 and gelatin at 0.81.

Layer 11 (Slow yellow layer): a blend of three blue sensitized (all with BSD-1) tabular silver iodobromide emulsions (i) 0.54×0.086, 1.3 mol % I at 0.395, (ii) 0.96×0.26, 6 mol % I at 0.233, (iii)) 1.03×0.13, 1.5 mol % I at 0.081; yellow dye forming coupler Y-1 at 0.735; DIR-3 at 0.027; B-1 at 0.003 and gelatin at 1.62.

Layer 12 (Fast yellow layer): a blue sensitized (with BSD-1) tabular silver iodobromide emulsion (2.9×0.13, 4.1 mol % I) at 0.414 and a 3D silver iodobromide emulsion (1.4 diameter, 14 mol % I) at 0.905; Y-1 at 0.426; DIR-3 at 0.027; B-1 at 0.011 and gelatin at 1.706.

Layer 13 (Protective overcoat and UV filter layer): silver bromide Lippman emulsion at 0.216; UV-1 and UV-2 both at 0.108, gelatin at 1.242 and bis(vinylsulfonyl) methane hardener at 1.75% of total gelatin weight.

Additional Samples ML-B-2 through ML-B-73 were prepared using the addenda indicated in Table 3. Unless otherwise noted, the comparative or inventive examples were dispersed in three times their own weight of N,N,-dibutyllauramide and were added to Layer 9 at 0.082 mmol/$m^2$. This represents a ratio of 6.8 mmol of compound to mol of silver in that layer.

Sample ML-B-30 contains inventive compound A dispersed as a solid particle dispersion. N,N-dibutyllauramide was also added as a separate dispersion to the same layer at 0.135.

Compounds CC-13, CC-14 and CC-15 were added to ML-B-14, ML-B-15 and ML-B-16 as water solutions.

Sample ML-B-36 contains inventive compound X dispersed in twice its own weight of N,N-dibutyllauramide (ClogP=7.66 and beta=0.93).

Sample ML-B-37 contains inventive compound X dispersed in twice its own weight of (Z)-9-octadecen-1-ol (ClogP=7.69 and beta=0.71).

Sample ML-B-38 contains inventive compound X dispersed in twice its own weight of ortho-methylphenyl benzoate (ClogP=4.12 and beta=0.43).

Sample ML-B-56 replaces M-1 in Layer 9 with M-12 (dispersed in its own weight of tricresyl phosphate) at 0.054. Sample ML-B-57 is as ML-B-56 with inventive compound X added to Layer 9 at 0.082 mmol/$m^2$.

Compounds CC-19 through CC-27 (Samples ML-B-20 to -28); inventive compounds AZ (Sample ML-B-58) and BB through BM (Samples ML-B-60 to -71) were dispersed in twice their weight in N,N-dibutyllauramide. Inventive compound BA (Sample ML-B-59) was dispersed in ten times its weight in N,N-dibutyllauramide.

Example ML-B-72 was like ML-B-1 except that inventive compound X was added to Layer 10 at 0.029 g/$m^2$.

TABLE 3

Multilayer ML-B Results

| Sample | Comp/Inv | Addenda | Speed of Neutral | Speed of G Only | Granularity (× $10^3$) |
|---|---|---|---|---|---|
| ML-B-1 | Comp | — | 0 (Check) | 0 (Check) | 21.2 |
| ML-B-2 | Comp | CC-1 | −0.20 | −0.17 | 23.4 |
| ML-B-3 | Comp | CC-2 | 0.00 | 0.00 | 20.6 |
| ML-B-4 | Comp | CC-3 | −0.10 | −0.10 | 20.0 |
| ML-B-5 | Comp | CC-4 | −0.10 | −0.10 | 20.0 |
| ML-B-6 | Comp | CC-5 | −1.57 | −1.10 | 25.6 |
| ML-B-7 | Comp | CC-6 | 0.07 | 0.03 | 24.3 |
| ML-B-8 | Comp | CC-7 | 0.03 | 0.03 | 17.8 |
| ML-B-9 | Comp | CC-8 | 0.03 | 0.03 | 19.3 |
| ML-B-10 | Comp | CC-9 | 0.03 | −0.03 | 8.6 |
| ML-B-11 | Comp | CC-10 | 0.06 | 0.03 | 18.2 |
| ML-B-12 | Comp | CC-11 | 0.03 | 0.03 | 22.1 |
| ML-B-13 | Comp | CC-12 | 0.03 | 0.10 | 18.3 |
| ML-B-14 | Comp | CC-13 | −0.10 | −0.07 | 17.3 |
| ML-B-15 | Comp | CC-14 | 0.00 | 0.00 | 17.8 |
| ML-B-16 | Comp | CC-15 | −0.03 | 0.00 | 17.3 |
| ML-B-17 | Comp | CC-16 | −0.30 | −0.23 | 26.2 |
| ML-B-18 | Comp | CC-17 | 0.10 | 0.10 | 27.2 |
| ML-B-19 | Comp | CC-18 | −0.27 | −0.20 | * |
| ML-B-20 | Comp | CC-19 | 0.03 | −0.10 | 18.9 |
| ML-B-21 | Comp | CC-20 | 0.03 | 0.06 | 17.7 |
| ML-B-22 | Comp | CC-21 | −0.77 | −0.80 | 17.5 |
| ML-B-23 | Comp | CC-22 | −0.07 | −0.17 | * |
| ML-B-24 | Comp | CC-23 | −0.07 | −0.07 | 17.5 |
| ML-B-25 | Comp | CC-24 | 0.03 | 0.00 | 17.9 |
| ML-B-26 | Comp | CC-25 | 0.00 | −0.03 | 28.1 |
| ML-B-27 | Comp | CC-26 | −0.57 | −0.60 | 17.4 |
| ML-B-28 | Comp | CC-27 | −0.10 | 0.03 | 20.9 |
| ML-B-29 | Inv | A | 0.37 | 0.37 | 18.3 |
| ML-B-30 | Inv | A | 0.30 | 0.27 | 19.3 |
| ML-B-31 | Inv | C | 0.37 | 0.37 | 20.8 |
| ML-B-32 | Inv | J | 0.37 | 0.37 | 20.9 |
| ML-B-33 | Inv | O | 0.13 | 0.17 | 16.8 |
| ML-B-34 | Inv | U | 0.13 | 0.20 | 21.0 |
| ML-B-35 | Inv | X | 0.27 | 0.27 | 20.1 |
| ML-B-36 | Inv | X | 0.23 | 0.27 | 18.9 |
| ML-B-37 | Inv | X | 0.17 | 0.17 | 20.2 |
| ML-B-38 | Inv | X | 0.00 | 0.03 | 18.6 |
| ML-B-39 | Inv | Y | 0.40 | 0.40 | 20.1 |
| ML-B-40 | Inv | Z | 0.40 | 0.43 | 20.9 |
| ML-B-41 | Inv | AA | 0.13 | 0.17 | 20.3 |
| ML-B-42 | Inv | AB | 0.23 | 0.23 | 21.4 |
| ML-B-43 | Inv | AC | 0.27 | 0.27 | 21.5 |
| ML-B-44 | Inv | AD | 0.27 | 0.30 | 20.2 |
| ML-B-45 | Inv | AE | 0.27 | 0.30 | 21.3 |
| ML-B-46 | Inv | AF | 0.30 | 0.33 | 21.1 |
| ML-B-47 | Inv | AG | 0.23 | 0.27 | 19.1 |
| ML-B-48 | Inv | AH | 0.23 | 0.23 | 18.9 |
| ML-B-49 | Inv | AI | 0.16 | 0.16 | 18.3 |
| ML-B-50 | Inv | AJ | 0.10 | 0.13 | 19.9 |
| ML-B-51 | Inv | AK | 0.17 | 0.17 | 17.7 |
| ML-B-52 | Inv | AL | 0.17 | 0.20 | 18.1 |
| ML-B-53 | Inv | AM | 0.20 | 0.23 | 17.9 |
| ML-B-54 | Inv | AN | 0.23 | 0.27 | 16.9 |
| ML-B-55 | Inv | AS | 0.20 | 0.20 | 17.8 |
| ML-B-56 | Comp | — | 0.03 | 0.00 | 19.0 |
| ML-B-57 | Inv | X | 0.10 | 0.10 | 19.3 |
| ML-B-58 | Inv | AZ | 0.27 | 0.33 | 16.8 |
| ML-B-59 | Inv | BA | 0.27 | 0.33 | 17.6 |
| ML-B-60 | Inv | BB | 0.33 | 0.33 | 16.9 |
| ML-B-61 | Inv | BC | 0.37 | 0.37 | 15.6 |
| ML-B-62 | Inv | BD | 0.40 | 0.40 | 17.4 |
| ML-B-63 | Inv | BE | 0.33 | 0.40 | 16.9 |
| ML-B-64 | Inv | BF | 0.33 | 0.37 | 15.7 |
| ML-B-65 | Inv | BG | 0.40 | 0.40 | 15.7 |
| ML-B-66 | Inv | BH | 0.07 | 0.10 | 17.7 |
| ML-B-67 | Inv | BI | 0.03 | 0.10 | 19.0 |
| ML-B-68 | Inv | BJ | 0.07 | 0.10 | 17.5 |
| ML-B-69 | Inv | BK | 0.10 | 0.10 | 18.6 |
| ML-B-70 | Inv | BL | 0.30 | 0.27 | 19.0 |
| ML-B-71 | Inv | BM | 0.23 | 0.23 | 18.1 |
| ML-B-72 | Inv | X | 0.07 | 0.13 | 18.7 |
| ML-B-73 | Inv | BN | 0.00 | 0.17 | 16.8 |

*Sample spoiled - no data.

As demonstrated by the data in Table 3 for format ML-B, only the compounds of the invention give enhanced photographic response to light while maintaining low granularity. The comparative compounds do not accomplish this result.

EXAMPLE 4

Sample ML-C-1

Layer 1 (Protective overcoat layer): gelatin at 0.872.

Layer 2 (UV filter layer): silver bromide Lippman emulsion at 0.215; UV-1 at 0.114 and UV-2 at 0.022 and gelatin at 0.861.

Layer 3 (Fast yellow layer): a 3D blue sensitized (with BSD-1) silver iodobromide emulsion of 2 diameter, 9 mol % I at 1.72; yellow dye forming couplers Y-1 at 0.082; Y-2 at 0.235 and gelatin at 2.0.

Layer 4 (Slow yellow layer): a blend of two blue sensitized (all with BSD-1) tabular silver iodobromide emulsions (i) 2.7×0.13, 6.0 mol % I at 0.484, (ii) ) 1.6×0.13, 4.5 mol % I at 0.323; Y-1 at 0.430; Y-2 at 0.099; developer inhibitor releaser DIR-3 at 0.039 and gelatin at 1.58.

Layer 5 (Yellow filter layer): YFD-1 at 0.151; DYE-3 at 0.043; ILS-2 at 0.108 and gelatin at 0.646.

Layer 6 (Fast magenta layer): a green sensitized (with a mixture of GSD-1 and GSD-2) silver iodobromide tabular emulsions (2.9×0.11, 3.7 mol % iodide) at 1.03; coupler M-2 at 0.059; masking coupler MC-2 at 0.022 and gelatin at 1.25.

Layer 7 (Mid magenta layer): a green sensitized (with a mixture of GSD-1 and GSD-2) silver iodobromide tabular emulsion 1.2×0.14, 4.5 mol % iodide at 1.28; M-4 at 0.12; M-5 at 0.074; M-12 at 0.022; MC-2 at 0.048; DIR-7 at 0.010 and gelatin at 1.42.

Layer 8 (Slow magenta layer): a green sensitized (a mixture of GSD-1 and GSD-2) silver iodobromide tabular emulsion: 0.7×0.14, 0.3 mol % iodide at 0.484; M-4 at 0.099; M-5 at 0.069; M-12 at 0.021; MC-2 at 0.086 and gelatin at 0.915.

Layer 9 (Interlayer): ILS-2 at 0.108 and gelatin at 1.08.

Layer 10 (Fast cyan layer): a blend of two red-sensitized sensitized (with a mixture of RSD-1 and RSD-2) emulsions: (i) a large sized iodobromide tabular grain emulsion (3.0×0.12, 4.0 mol % I) at 0.635, (ii) a smaller iodobromide tabular emulsion (1.3×0.14), 4.5 mol % I) at 0.334; C-1 at 0.060; Y-2 at 0.022; masking coupler MC-1 at 0.027; B-1 at 0.040 and gelatin at 1.32.

Layer 11 (Slow cyan layer): a blend of two red sensitized (all with a mixture of RSD-1 and RSD-2) silver emulsions: (i) a large sized iodobromide tabular grain emulsion (1.3×0.14, 4.5 mol % I) at 0.951, (ii) a smaller iodobromide tabular emulsion (1.0×0.11), 3.5 mol % I) at 0.675; C-1 at 0.409; Y-2 at 0.022; MC-1 at 0.011; B-1 at 0.058; DIR-1 at 0.044, and gelatin at 1.72.

Support

Cellulose triacetate with a RemJet backing on the side opposing the above light sensitive layers.

Example ML-C-2 was prepared like ML-C-1 except that nitrogen heterocycle compound A was added to Layer 6 at 0.022.

Examples ML-C-1 and ML-C-2 were exposed as for examples ML-A and ML-B and developed in a Kodak ECN-2™ Process. A complete description of the Kodak ECN-2™ Process is contained in the Kodak H-24 Manual (Manual for Processing Eastman Motion Picture Films; H-24 Manual; Eastman Kodak Company, Rochester, N.Y.) the description of which is incorporated herein by reference.

TABLE 4

Multilayer ML-C Results

| Sample | Comp/Inv | Addenda | Speed of Neutral | Speed of Green Only | Granularity |
|---|---|---|---|---|---|
| ML-C-1 | Comp | — | 0 (Check) | 0 (Check) | 8.58 |
| ML-C-2 | Inv | A | 0.19 | 0.13 | 8.20 |

As demonstrated by the results in Table 4 for multilayer ML-C, the compound of the invention gave enhanced photographic response to light (more speed) in a neutral exposure and reduced granularity. The improved response to light can not be attributed to development effects from adjacent layers (i.e. interimage) as the speed improvement with addenda A was also apparent in the Green Only exposure. Formulas for other materials used in this multilayer format are as follows:

B-1:

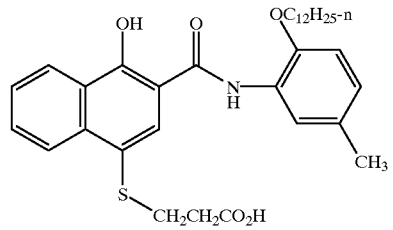

BSD-1:

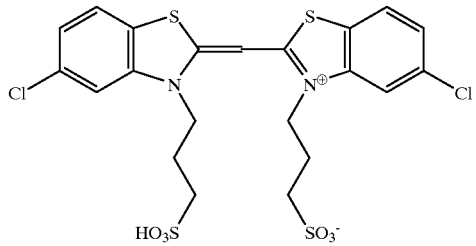

BSD-2:

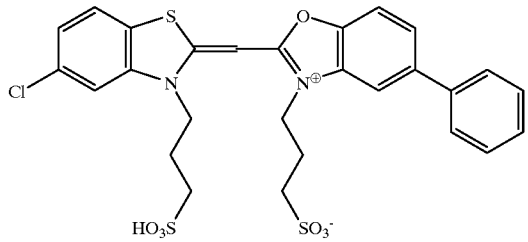

C-1:

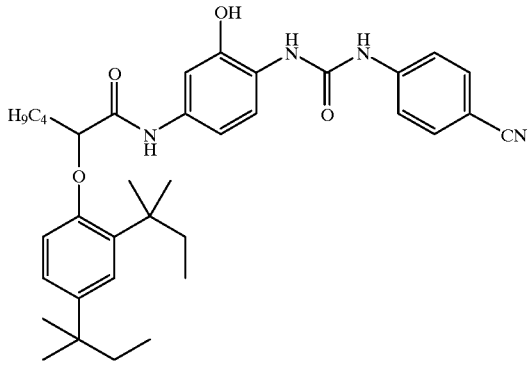

-continued
C-2:
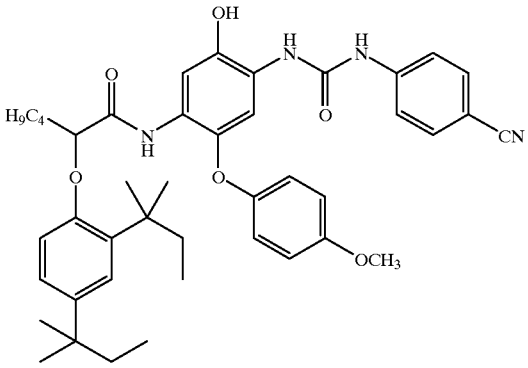
DIR-1:
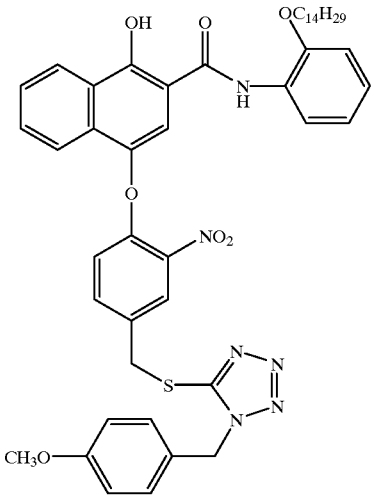
DIR-2:
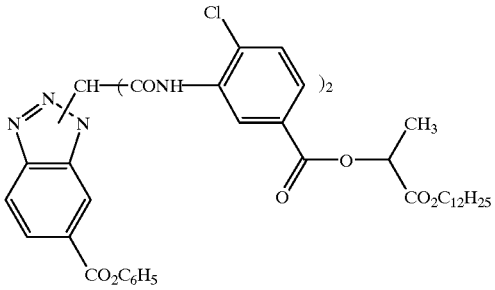
DIR-3:
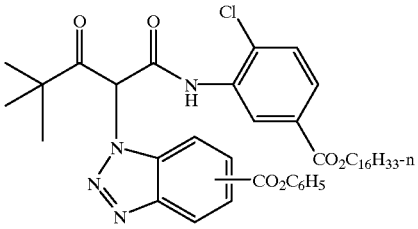
-continued
DIR-4:
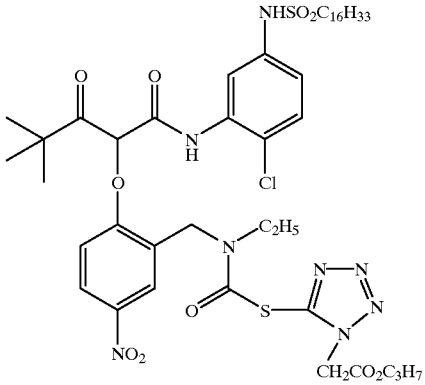
DIR-5:
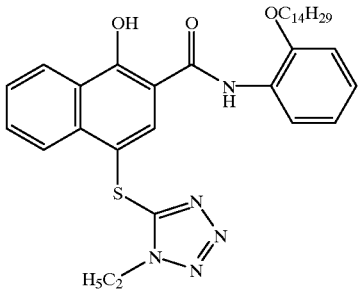
DIR-6:
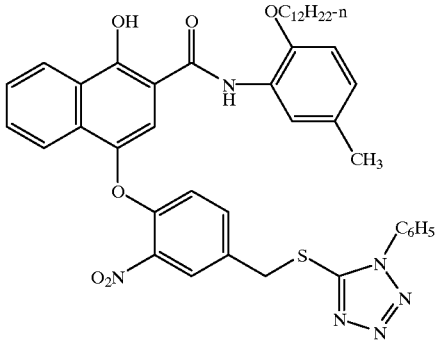
DIR-7:
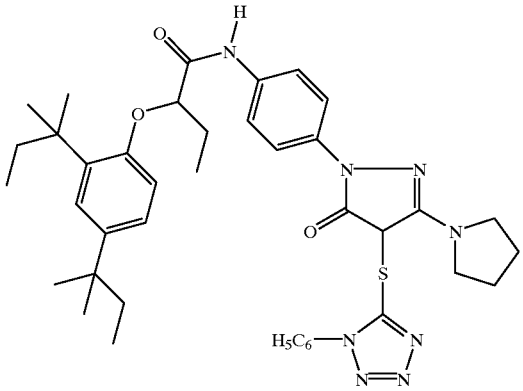

-continued
DIR-8:
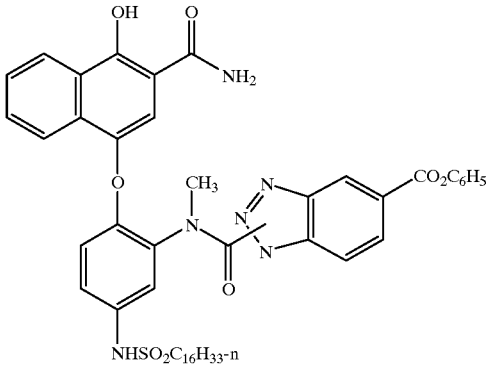
DIR-9:
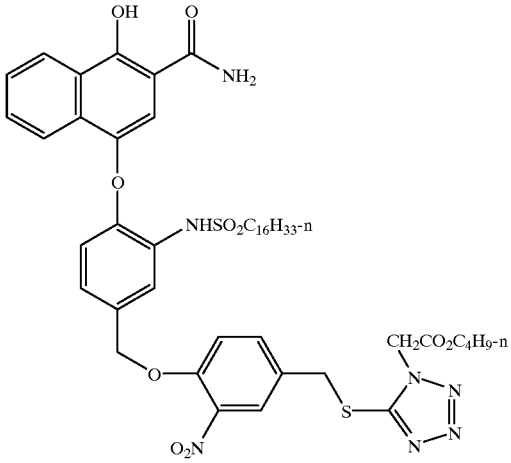
DIR-10:
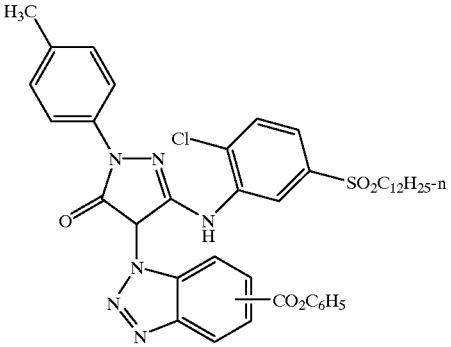
DYE-1:
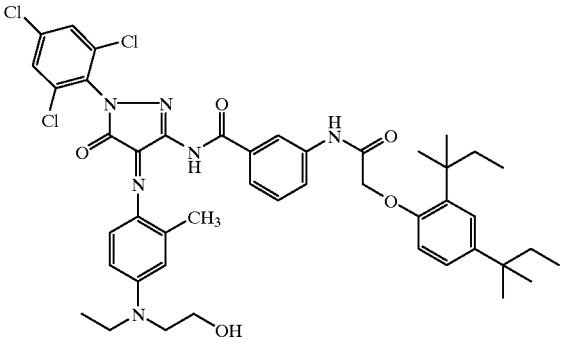
-continued
DYE-2:
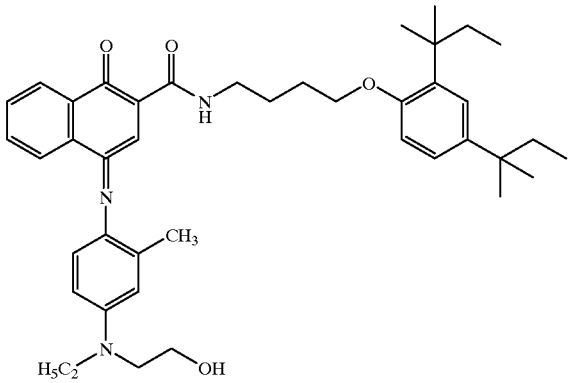
DYE-3:
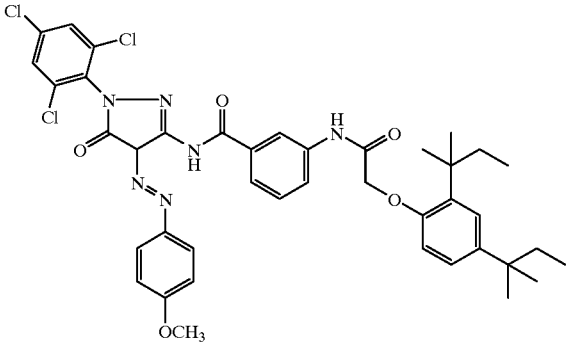
DYE-4:
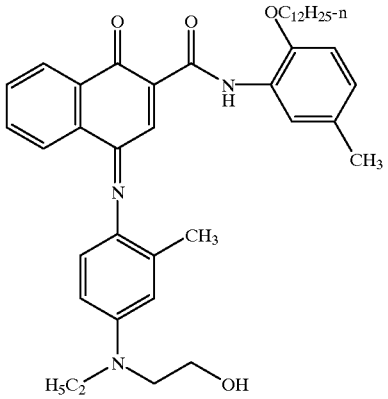
ILS-1:
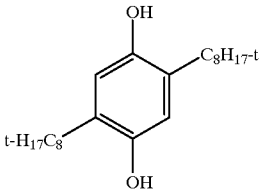
ILS-2:
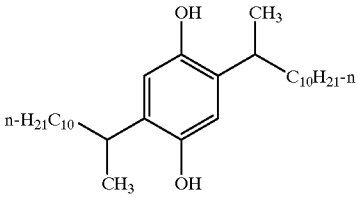

-continued
MC-1:
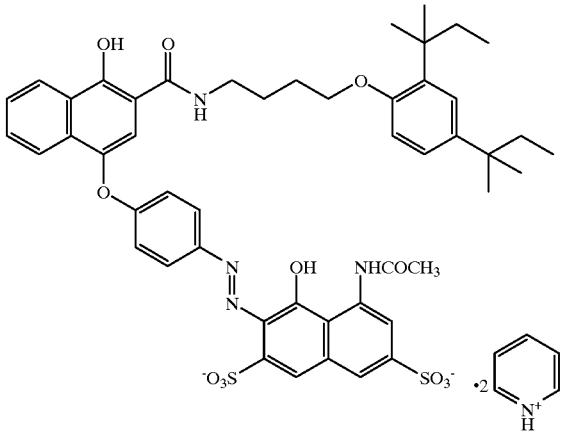
MC-2:
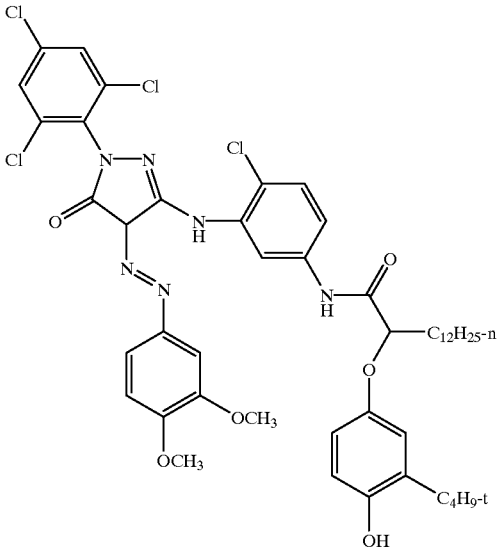
OxDS-1:
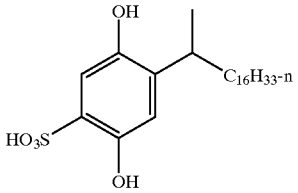
RSD-1:
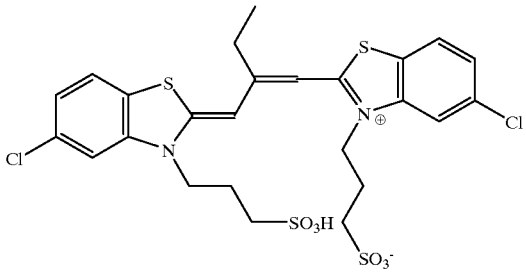
-continued
RSD-2:
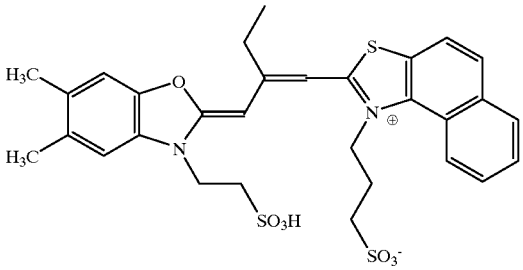
RSD-3:
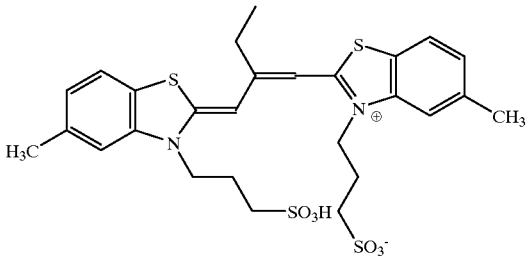
Y-1:
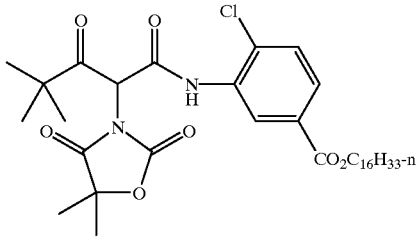
Y-2:
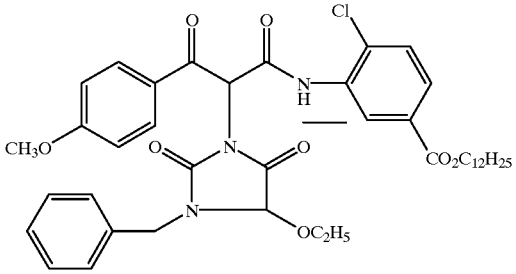
YFD-1:
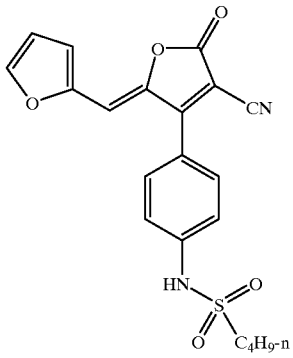
UV-1:
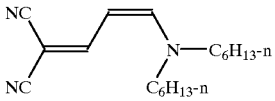

-continued
UV-2:
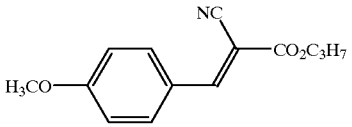
The structures of the comparative compounds along with the their ClogP values are as follows:
CC-1:
(4.80)
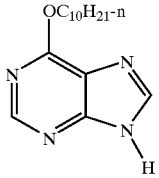
CC-2:
(0.20)
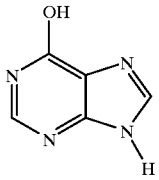
CC-3:
(-0.34)
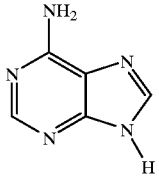
CC-4:
(-0.09)
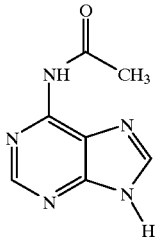
CC-5:
(0.49)
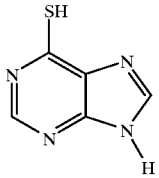
-continued
CC-6:
(5.86)
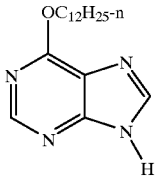
CC-7:
(8.18)
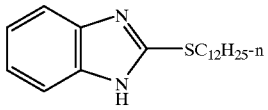
CC-8:
(9.45)
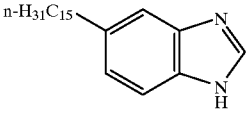
CC-9:
(7.87)
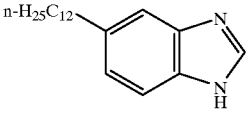
CC-10:
(7.78)
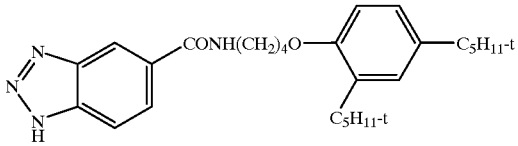
CC-11:
(4.70)
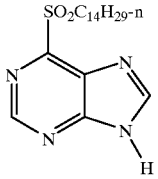
CC-12:
(1.89)
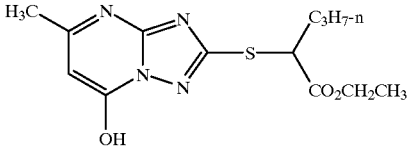
CC-13:
(-0.27)
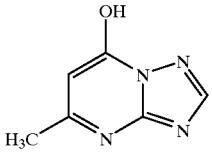

-continued

CC-14:
(0.37)

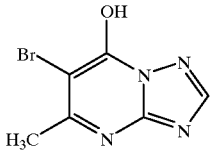

CC-15:
(0.61)

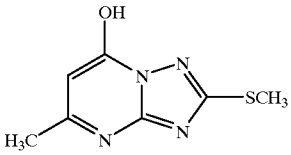

CC-16:
(3.43)

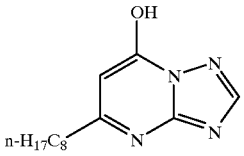

CC-17:
(4.23)

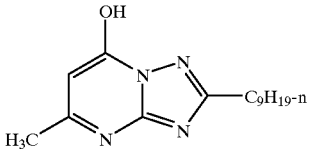

CC-18:
(4.31)

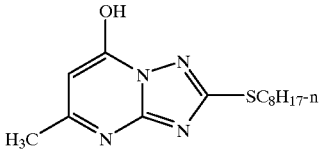

CC-19:
(7.15)

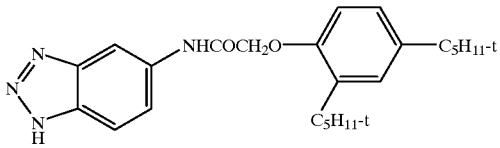

CC-20:
(7.49)

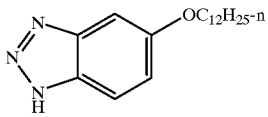

CC-21:
(6.89)

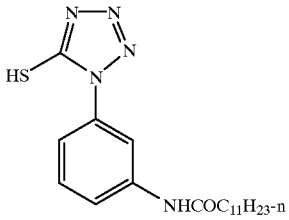

-continued

CC-22:
(6.33)

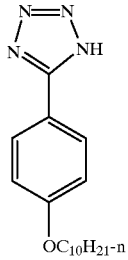

CC-23:
(6.59)

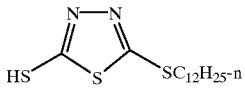

CC-24:
(7.50)

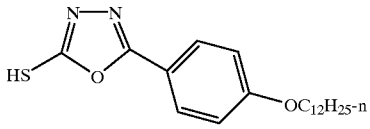

CC-25:
(10.56)

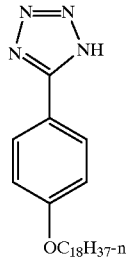

CC-26:
(3.89)

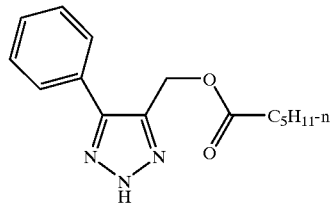

CC-27:
(8.08)

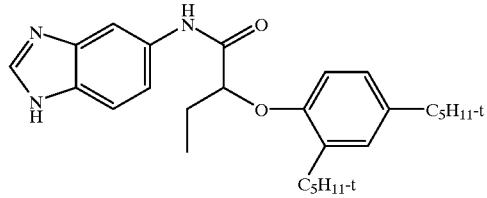

The invention has been described in detail with particular reference to preferred embodiments thereof, but it will be understood that variations and modifications can be effected within the scope and spirit of the invention.

What is claimed is:

1. A color photographic origination element comprising at least one of (1) a light sensitive silver halide emulsion layer and (2) a non-silver containing light insensitive layer, said at least one layer containing a compound with a minimum of three heteroatoms that does not react with oxidized developer and that has a ClogP sufficient to increase the photographic speed of said element compared to the same element without the compound.

2. The color photographic element of claim 1 wherein the compound is contained in a light sensitive emulsion layer.

3. The color photographic element of claim 2 wherein the light sensitive layer is the most sensitive layer of two or more layers having the same spectral sensitivity.

4. The color photographic element of claim 1 wherein the compound is contained in a non-silver containing light insensitive layer.

5. The color photographic element of claim 4 wherein the compound is contained in a non-silver containing light insensitive layer adjacent to a light sensitive layer.

6. The color photographic element of claim 5 wherein the light sensitive layer is the most light-sensitive of two or more light sensitive layers of the same spectral sensitivity.

7. The color photographic element of claim 5 in which the non-silver containing light insensitive layer is located between two light sensitive layers.

8. The color photographic element of claim 7 in which the compound is a 6/5 bicyclic heterocycle selected from the group of 1,2,5,7-tetraazaindenes with a ClogP of at least 6.2,1,2,4,6-tetraazaindenes with a ClogP of at least 6.2,1,3,4,6-tetraazaindenes (purines) with a ClogP of at least 6.2 or benzotriazoles with a ClogP of at least 7.8.

9. The color photographic element of claim 7 in which the compound is a bicyclic heterocycle with a ClogP of at least 6.2 or greater selected from the group of 1,2,3a,7-tetraazaindenes or 1,3,3a,7-tetraazaindenes.

10. The color photographic element of claim 7 in which the compound is a monocyclic heterocycle selected from the group of triazoles with a ClogP of at least 8.75, oxadiazoles or thiadiazoles with a ClogP of at least 7.6, mercaptotetrazoles with a ClogP of at least 7.0, and tetrazoles with a ClogP of at least 6.5 and not more than 10.5.

11. The element of claim 7 wherein the interlayer is located between two light sensitive layers sensitive to different colors.

12. The element of claim 11 wherein the interlayer is a non-silver containing layer located between a blue sensitive and a green sensitive color record.

13. The element of claim 11 wherein the interlayer is a non-silver containing layer located between a green sensitive and a red sensitive color record.

14. The color photographic element of claim 5 in which the compound is present at a laydown of $3.0\times10^{-5}$ mol/m$^2$ or greater.

15. The color photographic element of claim 5 in which the compound is dispersed in an organic solvent that has a ClogP of 5.0 or greater and a beta of 0.4 or more.

16. The color photographic element of claim 15 wherein the organic solvent has a beta of 0.5 or more.

17. The color photographic element of claim 5 in which the non-silver containing light insensitive layer additionally contains a scavenger for oxidized developer.

18. The color photographic element of claim 1 wherein at least one heteroatom of the compound is nitrogen.

19. The color photographic element of claim 18 wherein the compound is a nitrogen heterocycle containing at least two fused rings.

20. The color photographic element of claim 1 in which the silver halide comprises silver iodobromide.

21. The color photographic element of claim 20 in which the silver iodobromide has maximum spectral sensitivity to light with wavelength between 500 and 600 nm.

22. The element of claim 10 wherein the layer containing the compound additionally contains a pyrazolone or pyrazoloazole coupler.

23. A color photographic element of claim 22 in which the compound is selected from a 1,3,4,6,a1,2,4,6 or a 1,2,5,7-tetraazaindene compound or a benzotriazole.

24. The element of claim 22 wherein the layer additionally contains a pyrazoloazole coupler.

25. The color photographic element of claim 1 wherein the compound is a 1,3,4,6-tetraazaindene (purine) with a ClogP of at least 6.2 or greater.

26. The color photographic element of claim 11 wherein the 1,3,4,6-tetraazaindene is represented by the Formula I:

I

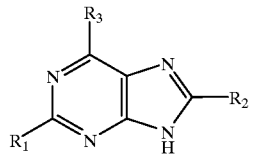

wherein $R_1$ and $R_2$ are each independently hydrogen or an alkyl, aryl, alkoxy or aryloxy, alkylthio or arylthio, sulfoxyl, sulfonyl, sulfamoyl, fluoro, chloro, bromo, iodo, cyano, nitro, —O—CO—, —O—$SO_2$—, heterocyclic, carbonyl, amino, carbonamido, or sulfonamido group and $R_3$ is an alkyl, aryl, alkoxy, aryloxy, alkylthio, arylthio, secondary or tertiary amino, carbonamido, sulfonyl or a sulfonamido group.

27. The color photographic element of claim 26 wherein $R_3$ is an alkoxy or alkylthio group.

28. The color photographic element of claim 26 wherein the ratio of the number of millimoles of the nitrogen heterocyclic compound to the number of mols of silver in the same layer is at least 1.0.

29. The color photographic element of claim 1 wherein the compound is a benzotriazole with ClogP of at least 7.8.

30. The color photographic element of claim 29 in which the silver halide emulsion is silver iodobromide.

31. The color photographic element of claim 30 in which the silver iodobromide has maximum spectral sensitivity to light with wavelength between 500 and 600 nm.

32. The color photographic element of claim 15 wherein the benzotriazole is represented by Formula V:

V

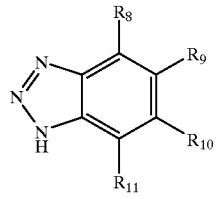

wherein $R_8$, $R_9$, $R_{10}$ and $R_{11}$ each individually represents hydrogen or an alkyl, aryl, alkoxy or aryloxy, alkylthio or arylthio, sulfoxyl, sulfonyl, sulfamoyl, fluoro, chloro, bromo, iodo, cyano, nitro, —O—CO—, —O—$SO_2$—, heterocyclic, carbonyl, carbonamido, sulfonamido, or an amino group.

33. The color photographic element of claim 32 wherein $R_8$ and $R_{11}$ are hydrogen and where $R_9$ is a carboxylate ester, a carbamoyl group, a carbonamido group, a sulfonamido group or an alkoxy or aryloxy group.

34. The color photographic element of claim 1 wherein the compound is a triazole with ClogP of at least 8.75.

35. The color photographic element of claim 34 in which the silver halide emulsion is silver iodobromide.

36. The color photographic element of claim 35 in which the silver iodobromide has maximum spectral sensitivity to light with wavelength between 500 and 600 nm.

37. The color photographic element of claim 34 wherein the triazole is a 1,2,3-triazole represented by Formula VI:

VI

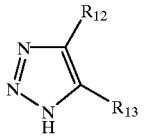

where $R_{12}$ is hydrogen, alkyl or aryl and $R_{13}$ is a alkylthio or arylthio, carboxylate ester or substituted alkyl group.

38. The color photographic element of claim 34 wherein the triazole is a 1,2,4-triazole represented by Formula VII:

VII

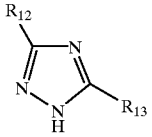

where $R_{12}$ is hydrogen, alkyl or aryl and $R_{13}$ is a alkylthio or arylthio, carboxylate ester or substituted alkyl group.

39. The color photographic element of claim 1 wherein the compound is selected from a tetrazole with ClogP of at least 6.5 but less than or equal to 10.5 or a mercaptotetrazole with ClogP of at least 7.0.

40. The color photographic element of claim 30 in which the silver halide emulsion is silver iodobromide.

41. The color photographic element of claim 20 in which the silver iodobromide has maximum spectral sensitivity to light with wavelength between 500 and 600 nm.

42. The color photographic element of claim 30 wherein the tetrazole represented by Formula IX:

IX

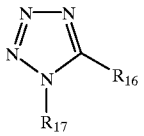

where $R_{16}$ is a thiol group and $R_{17}$ is an alkyl, aryl or heterocyclic group; or when $R_{17}$ is hydrogen and $R_{16}$ is an alkyl, aryl, amino, alkoxy or aryloxy, heterocyclic or alkylthio or arylthio group.

43. The color photographic element of claim 42 where $R_{16}$ is a thiol group and $R_{17}$ is an alkyl or aryl group.

44. The color photographic element of claim 42 where $R_{17}$ is hydrogen and $R_{16}$ is an alkyl, aryl or alkylthio or arylthio group.

45. The color photographic element of claim 1 wherein the compound is selected from an oxa- or thia-diazole with ClogP of at least 7.6.

46. The color photographic element of claim 45 in which the silver halide emulsion is silver iodobromide.

47. The color photographic element of claim 46 in which the silver iodobromide has maximum spectral sensitivity to light with wavelength between 500 and 600 nm.

48. The color photographic element of claim 45 wherein the heterocycle is an oxadiazole represented by Formula VIII:

VIII

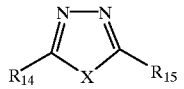

where X is oxygen; $R_{14}$ is a thiol group and $R_{15}$ is an alkyl, aryl, alkylthio or arylthio or amino group.

49. The color photographic element of claim 31 wherein the heterocycle is an thiadiazole represented by Formula VIII:

VIII

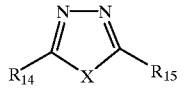

where X is sulfur; $R_{14}$ is a thiol group and $R_{15}$ is an alkyl, aryl, alkylthio or arylthio or amino group.

50. The color photographic element of claim 1 wherein the compound is dispersed in an organic solvent that has a ClogP of 5.0 or greater and a beta of 0.4 or more.

51. The color photographic element of claim 50 wherein the organic solvent has a beta of 0.5 or more.

52. The color photographic element of claim 1 wherein the compound is dispersed in a finely ground solid particle state.

53. The color photographic element of claim 1 in which the silver halide emulsion has an equivalent circular diameter at of least 1 micrometer.

54. A color photographic element of claim 53 in which the compound is selected from a 1,3,4,6, a1,2,4,6 or a 1,2,5,7-tetraazaindene compound or a benzotriazole.

55. The photographic element of claim 1 in which the compound is present in an amount sufficient to increase the speed of a neutral exposure by at least 0.1 of a stop compared to the same element without the compound.

56. The photographic element of claim 1 in which the compound is a monocyclic heterocycle comprising carbon and at least two nitrogen atoms with at most only one ring sulfur or ring oxygen atom.

57. The color photographic element of claim 54 in which the heterocycle contains a ring sulfur atom.

58. A process for forming a photographic image, comprising contacting with a p-phenylenediamine color developer the photographic element as described in claim 1.

59. The process of claim 58 wherein the color developer comprises 2-[(4-amino-3-methylphenyl)ethylamino]ethanol or 4-amino-3-methyl-N-ethyl-N-(2-methanesulfonamidoethyl)aniline.

60. The process of claim 58 in which the nitrogen heterocyclic compound is selected from a 1,3,4,6, a1,2,4,6, a1,2,5,7-tetraazaindene or a benzotriazole.

61. The process of claim 58 in which the light sensitive silver halide emulsion layer has a maximum spectral sensitivity to light between 500 and 600 nm.

62. The process of claim 58 in which the photographic element contains a plurality of layers having maximum spectral sensitivity to light between 500 and 600 nm but differing in light sensitivity and the heterocycle compound is located in the most light sensitive layer of such layers or in a light insensitive layer adjacent to the most light sensitive layer.

63. The element of claim 58 wherein the layer additionally contains a pyrazolone or pyrazoloazole dye-forming coupler.

64. The element of claim 1 wherein the element is a color negative element for image capture provided on a transparent support.

65. A single use camera comprising the combination of a lens and a photographic element as describe in claim 1.

66. The color photographic element of claim 1 wherein the compound is selected from a 1,2,3a,7-tetraazaindene or a 1,3,3a,7-tetraazaindene with ClogP of at least 6.8.

67. The color photographic element of claim 66 in which the silver halide emulsion is silver iodobromide.

68. The color photographic element of claim 67 in which the silver iodobromide has maximum spectral sensitivity to light with wavelength between 500 and 600 nm.

69. The color photographic element of claim 66 wherein the tetraazaindene is represented by either Formula III or IV:

III

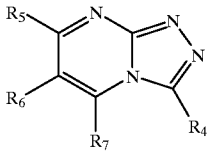

IV

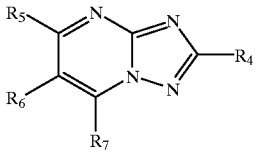

wherein $R_4$, $R_5$, $R_6$ and $R_7$ each individually represents hydrogen or an alkyl, aryl, alkoxy or aryloxy, alkylthio or arylthio, sulfoxyl, sulfonyl, sulfamoyl, chloro, bromo, iodo, cyano, nitro, —O—CO—, —O—$SO_2$—, heterocyclic, carbonyl, amino, hydroxyl or thiol group.

70. The color photographic element of claim 69 wherein $R_7$ is a hydroxyl group and $R_5$ is an alkyl group.

71. The color photographic element of claim 1 wherein the compound is selected from a 1,2,4,6-tetraazaindene or a 1,2,5,7-tetraazaindene with a ClogP of at least 6.2 or greater.

72. The color photographic element of claim 71 in which the silver halide emulsion is silver iodobromide.

73. The color photographic element of claim 72 in which the silver iodobromide has maximum spectral sensitivity to light with wavelength between 500 and 600 nm.

74. The color photographic element of claim 71 wherein the tetraazaindene is represented either by Formula IIa or IIb;

IIa

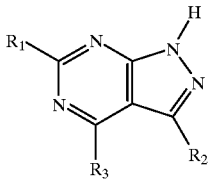

IIb

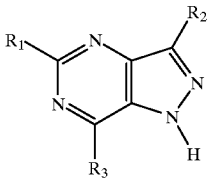

wherein $R_1$ and $R_2$ are each independently hydrogen or an alkyl, aryl, alkoxy or aryloxy, alkylthio or arylthio, sulfoxyl, sulfonyl, sulfamoyl, chloro, bromo, iodo, cyano, nitro, —O—CO—, —O—$SO_2$—, heterocyclic, carbonyl or an amino group and $R_3$ is an alkyl, aryl, alkoxy, aryloxy, alkylthio, arylthio, secondary or tertiary amino, carbonamido, sulfonyl or a sulfonamido group.

75. The color photographic element of claim 74 wherein $R_3$ is an alkoxy or alkylthio group.

76. The element of claim 1 wherein the compound is a polymer compound wherein the monomeric species of which the polymer is comprised exhibits a ClogP sufficient to improve the speed commpared to the same element without the compound.

77. The element of claim 1 wherein the compound is contained in an interlayer located between an imaging layer and an antihalation layer.

78. A color photographic origination element comprising at least one of (1) a light sensitive silver halide emulsion layer and (2) a non silver containing light insensitive layer, said layer containing a heterocycle compound with a minimum of three heteroatoms as part of the ring system that does not react with oxidized developer and that has a ClogP sufficient to increase the photographic speed of said element compared to the same element without the compound.

79. The color photographic element of claim 78 in which the silver halide is silver iodobromide.

80. The color photographic element of claim 79 in which the silver iodobromide has maximum spectral sensitivity to light with wavelength between 500 and 600 nm.

81. The color photographic element of claim 78 wherein the ratio of number of millimoles of the heterocyclic compound to the number of moles of silver in the same layer is greater than 1.0.

82. The photographic element of claim 81 in which the heterocycle is a bicyclic 6/5 nitrogen heterocycle that contains at least 3 nitrogen atoms.

83. The photographic element of claim 57 in which the heterocycle is a monocyclic heterocycle comprising carbon and at least two nitrogen atoms with at most only one ring sulfur or ring oxygen atom.

84. The color photographic element of claim 78 wherein the compound is selected from a 1,3,4,6-tetraazaindene, a 1,2,4,6 tetraazaindene and a 1,2,5,7-tetraazaindene any of which has a ClogP of at least 6.2 and equal to or less than 13 and wherein the ratio of the number of millimoles of the tetraazaindene to the number of moles of silver in the same layer is at least 1.0.

85. The color photographic element of claim 78 wherein the heterocycle is a benzotriazole with ClogP of at least 7.8 and not more than 13.0 and the ratio of number of millimoles of the benzotriazole to the number of moles of silver in the same layer is at least 1.0.

86. The color photographic element of claim 78 wherein the heterocycle is a triazole with ClogP of at least 8.75 but less than or equal to 13.0 and the ratio of number of millimoles of the triazole to the number of moles of silver in the same layer is at least 1.0.

87. The color photographic element of claim 78 wherein the heterocycle is selected from a tetrazole with ClogP of at least 6.5 but less than or equal to 10.5 or a mercaptotetrazole with ClogP of at least 7.0 but less than or equal to 13.0 and the ratio of number of millimoles of the tetrazole or mercaptotetrazole to the number of moles of silver in the same layer is at least 1.0.

88. The color photographic element of claim 78 wherein the heterocycle is selected from an oxa- or thia-diazole with ClogP of at least 7.6 but less than or equal to 11.5 and the ratio of number of millimoles of the oxa- or thia-diazole to the number of moles of silver in the same layer is at least 1.0.

89. The color photographic element of claim 78 wherein the nitrogen heterocyclic compound is selected from the group consisting of:

A

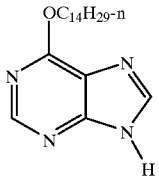

X

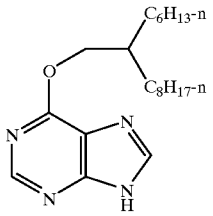

AK

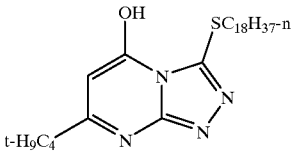

BD

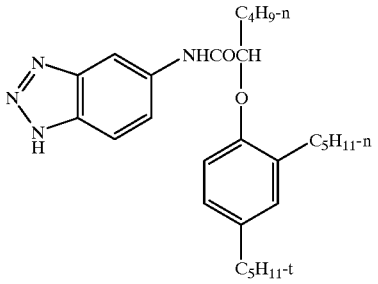

BG

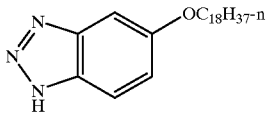

and

-continued

BL

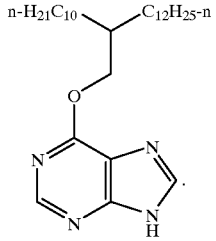

90. A color photographic element of claim 78 in which the photographic element contains a plurality of layers of the same spectral sensitivity but of differing light sensitivity and the heterocycle compound is located in the most light sensitive layer of such layers.

91. A color photographic origination element comprising at least one of (1) a light sensitive silver halide emulsion layer and (2) a non-silver containing light insensitive layer, said layer containing a nitrogen heterocycle compound with at least two fused rings, of which at least one is a six membered ring; and which contains as part of those two fused rings at least 4 nitrogen atoms in which 3 of said nitrogen atoms cannot be consecutive unless either (a) one of the 3 consecutive nitrogens is in a bridgehead position or (b) all 3 of the consecutive nitrogens are in the same six membered ring; and provided that the ClogP for the compound is at least 6.2.

92. The element of claim 91 wherein the nitrogen heterocycle compound is contained in a non-silver containing light-insensitive layer.

93. The element of claim 91 wherein the nitrogen heterocycle compound is contained in a light sensitive silver iodobromide emulsion layer.

94. The color photographic element of claim 93 wherein the ClogP of the compound is equal to or less than 11.5.

95. The color photographic element of claim 91 wherein the ClogP of the nitrogen heterocyclic compound is at least 6.8 but equal to or less than 13.

96. The color photographic element of claim 95 wherein the ratio of the number of millimoles of the nitrogen heterocyclic compound to the number of moles of silver in the same layer is at least 1.0.

97. The color photographic element of claim 91 wherein the ClogP of the nitrogen heterocyclic compound is at least 7.2 but equal to or less than 13.

98. The color photographic element of claim 17 wherein the ratio of the number of millimoles of the nitrogen heterocyclic compound to the number of moles of silver in the same layer is at least 1.0.

99. The color photographic element of claim 91 wherein the ratio of the number of millimoles of the nitrogen heterocyclic compound to the number of moles of silver in the same layer is at least 1.0.

100. The color photographic element of claim 90 wherein the nitrogen heterocyclic compound is a 1,3,4,6-tetraazaindene (purine).

101. The color photographic element of claim 90 wherein the nitrogen heterocyclic compound is selected from a 1,2,5,7-tetraazaindene or a 1,2,4,6-tetraazaindene.

102. The color photographic element of claim 90 wherein the nitrogen heterocyclic compound is a 1,2,3a,7-tetraazaindene.

103. The color photographic element of claim 90 wherein the nitrogen heterocyclic compound is a 1,3,3a,7-tetraazaindene.

104. The color photographic element of claim 90 wherein the light sensitive layer containing the nitrogen heterocyclic compound has maximum spectral sensitivity to light with wavelength between 500 and 600 nm.

105. The color photographic element of claim 99 wherein the nitrogen heterocyclic compound is dispersed in a organic solvent that has a ClogP of 5.0 or greater and a beta of 0.4 or more.

106. The color photographic element of claim 105 wherein the organic solvent has a beta of 0.5 or more.

107. The color photographic element of claim 99 wherein the nitrogen heterocyclic compound is dispersed in a finely ground solid particle state.

108. The color photographic element of claim 91 wherein the nitrogen heterocyclic compound is selected from a 1,2,5,7-tetraazaindene, a 1,2,4,6-tetraazaindene or a 1,3,4,6-tetraazaindene (purine).

109. The color photographic element of claim 91 wherein the nitrogen heterocyclic compound is a 1,2,3a,7-tetraazaindene.

110. The color photographic element of claim 109 wherein the 1,2,3a,7-tetraazaindene compound is represented by Formula III:

III

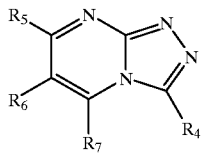

wherein $R_5$, $R_6$ and $R_7$ each individually represents hydrogen or a hydroxy, thiol, alkyl, aryl, alkoxy or aryloxy, alkylthio or arylthio, sulfoxyl, sulfonyl, sulfamoyl, fluoro, chloro, bromo, iodo, cyano, nitro, —O—CO—, —O—$SO_2$—, heterocyclic, carbonyl, carbonamido, sulfonamido, or an amino group; and $R_4$ is an alkyl, aryl, alkoxy, aryloxy, alkylthio or arylthio group.

111. The color photographic element of claim 110 wherein $R_7$ is a hydroxy group.

112. The color photographic element of claim 111 wherein $R_5$ is an alkyl group.

113. The color photographic element of claim 110 wherein the ratio of number of millimoles of the compound of Formula III to the number of moles of silver in the same layer is greater than 1.0.

114. The color photographic element of claim 91 wherein the nitrogen heterocyclic compound is a 1,2,3a,7-tetraazaindene.

115. The color photographic element of claim 114 wherein the 1,3,3a,7-tetraazaindene compound is represented by Formula IV:

IV

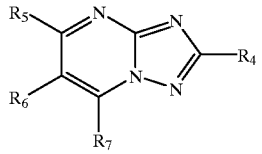

wherein $R_5$, $R_6$ and $R_7$ each individually represents hydrogen or a hydroxy, thiol, alkyl, aryl, alkoxy or aryloxy, alkylthio or arylthio, sulfoxyl, sulfonyl, sulfamoyl, fluoro, chloro, bromo, iodo, cyano, nitro, —O—CO—, —O—$SO_2$—, heterocyclic, carbonyl, carbonamido, sulfonamido, or an amino group; and $R_4$ is an alkyl, aryl, alkoxy, aryloxy, alkylthio, arylthio, secondary or tertiary amino, carbonamido, sulfonyl or a sulfonamido group.

116. The color photographic element of claim 115 wherein $R_7$ is a hydroxy group.

117. The color photographic element of claim 116 wherein $R_5$ is an alkyl group.

118. The color photographic element of claim 91 wherein the light sensitive layer containing the nitrogen heterocyclic compound has maximum spectral sensitivity to light with wavelength between 500 and 600 nm.

119. The color photographic element of claim 115 wherein the ratio of number of millimoles of the nitrogen heterocyclic compound to the number of moles of silver in the same layer is greater than 1.0.

120. The color photographic element of claim 118 wherein the nitrogen heterocyclic compound is selected from the group consisting of:

A:

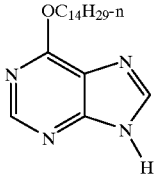

X:

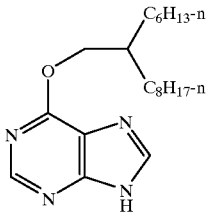

AK:

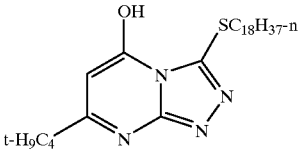

BD:

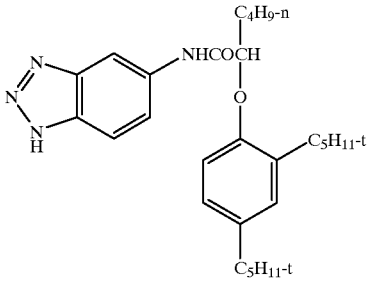

BG:

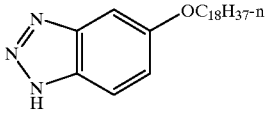

and

-continued

BL:

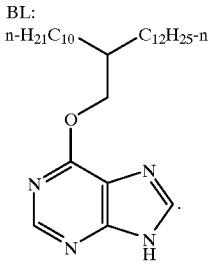

121. A color photographic element of claim 118 in which the photographic element contains a plurality of layers of the same spectral sensitivity but of differing light sensitivity and the heterocycle compound is located in the most light sensitive layer of such layers.

122. The color photographic element of claim 91 in which the heterocycle is located in a non-silver containing light insensitive layer adjacent to a light sensitive layer.

123. The color photographic element of claim 122 in which the heterocycle is present at a laydown of at least $3.0\times10^{-5}$ mols/$m^2$.

124. A color photographic origination element comprising at least one of (1) a light sensitive silver halide emulsion layer and (2) a non-silver containing light insensitive layer, said layer containing a nitrogen heterocyclic compound with at least two fused rings, of which at least one is a six membered ring; and which contains as part of those two fused rings at least 4 nitrogen atoms in which 3 of said nitrogen atoms cannot be consecutive unless either (a) one of the 3 consecutive nitrogens is in a bridgehead position or (2) all 3 of the consecutive nitrogens are in the same six membered ring; wherein the nitrogen heterocyclic compound is substituted with an alkoxy or alkylthio group that contains at least fourteen carbon atoms.

125. The color photographic element of claim 124 wherein the ratio of the number of millimoles of the nitrogen heterocyclic compound to the number of moles of silver in the same layer is at least 1.0.

126. The color photographic element of claim 124 in which the nitrogen heterocyclic compound is selected from 1,3,4,6-tetraazaindene, 1,2,5,7-tetraazaindene and 1,2,4,6-tetraazaindene compounds.

127. A color photographic element comprising a light sensitive silver halide emulsion layer containing an image dye-forming coupler and a heterocycle compound which does not react with oxidized developer the compound having a minimum of three heteroatoms as part of the ring system and having a ClogP sufficient to increase the speed of said layer compared to the same layer without the compound and wherein the molar ratio of the dye-forming coupler(s) to the silver present in the layer is less than 0.5.

128. The element of claim 127 wherein the molar ratio is less than 0.2.

129. A color photographic element comprising at least one of (1) a light sensitive silver halide emulsion layer and (2) a non-silver containing light insensitive layer, said at least one layer containing a compound with a minimum of three heteroatoms that does not react with oxidized developer and that has a ClogP sufficient to increase the photographic speed of said element compared to the same element without the compound wherein the compound is dispersed in an organic solvent that has a ClogP of 5.0 or greater and a beta of 0.4 or more.

130. A color photographic element comprising at least one of (1) a light sensitive silver halide emulsion layer and (2) a non-silver containing light insensitive layer, said at least one layer containing a compound with a minimum of three heteroatoms that does not react with oxidized developer and that has a ClogP sufficient to increase the photographic speed of said element compared to the same element without the compound wherein the compound is present in an amount sufficient to increase the speed of a neutral exposure by at least 0.1 of a stop compared to the same element without the compound.

131. A color photographic element comprising at least one of (1) a light sensitive silver halide emulsion layer and (2) a non-silver containing light insensitive layer, said at least one light sensitive layer containing a compound with a minimum of three heteroatoms that does not react with oxidized developer and that has a ClogP sufficient to increase the photographic speed of said element compared to the same element without the compound.

132. A color photographic element comprising at least one of (1) a light sensitive silver halide emulsion layer and (2) a non-silver containing light insensitive layer, said at least one layer containing a compound with a minimum of three heteroatoms that does not react with oxidized developer and that has a ClogP sufficient to increase the photographic speed of said element compared to the same element without the compound wherein the compound is selected from the group consisting of:

a 1,2,5,7-tetraazaindene, a 1,2,4,6-tetraazaindene, a 1,2,3a,7-tetraazaindene, a 1,3,3a,7-tetraazaindene, and a 1,3,4,6-tetraazaindene, such compound having a ClogP of at least 6.2;

a benzotriazole with ClogP of at least 7.8;

a triazol with ClogP of at least 8.75;

a tetrazole with ClogP of at least 6.5 but less than or equal to 10.5 or a mercaptotetrazole with ClogP of at least 7.0; and an oxa- or thia-diazole with ClogP of at least 7.6.

133. A color photographic element comprising at least one of (1) a light sensitive silver halide emulsion layer and (2) a non-silver containing light insensitive layer, said at least one layer containing a nitrogen heterocycle compound with at least two fused rings, of which at least one is a six membered ring; and which contains as part of those two fused rings at least 4 nitrogen atoms in which 3 of said nitrogen atoms cannot be consecutive unless either (a) one of the 3 consecutive nitrogens is in a bridgehead position or (b) all 3 of the consecutive nitrogens are in the same six membered ring; and provided that the ClogP for the compound is at least 6.2, wherein the silver halide is silver iodobromide.

* * * * *